US005274917A

United States Patent [19]

Corbett, III et al.

[11] Patent Number: 5,274,917

[45] Date of Patent: Jan. 4, 1994

[54] METHOD OF MAKING CONNECTOR WITH MONOLITHIC MULTI-CONTACT ARRAY

[75] Inventors: Scott S. Corbett, III, Portland; David F. Miller, Aloha; James F. McIntire, Boring; Jerry Martyniuk, Portland; Larry L. Davis, West Linn; Daniel DeLessert, Newberg; Michael L. Demeter, Vernonia, all of Oreg.

[73] Assignee: The Whitaker Corporation, Wilmington, Del.

[21] Appl. No.: 895,518

[22] Filed: Jun. 8, 1992

[51] Int. Cl.[5] ..... H01R 43/02

[52] U.S. Cl. ..... 29/860; 264/263; 264/272.15

[58] Field of Search ..... 29/828, 857, 860; 264/263, 272.15, 272.19

[56] References Cited

U.S. PATENT DOCUMENTS

| | | | |
|---|---|---|---|
| 2,421,155 | 5/1947 | Miller et al. | 264/263 X |
| 2,973,501 | 2/1961 | Mapelsden et al. | 264/272.15 X |
| 2,989,784 | 6/1961 | Aamodt | 29/828 X |
| 3,573,704 | 4/1971 | Tarver . | |
| 3,668,779 | 6/1972 | Turner | 264/263 X |
| 3,852,878 | 12/1974 | Munro | 29/629 |
| 3,924,916 | 12/1975 | Venaleck | 339/17 |
| 4,125,310 | 11/1978 | Reardon, II . | |
| 4,195,272 | 3/1980 | Boutros | 29/828 X |
| 4,339,407 | 7/1982 | Leighton | 264/263 X |
| 4,395,375 | 7/1983 | Ferris et al. | 264/272.15 X |
| 4,434,134 | 2/1984 | Darrow et al. | 419/5 |
| 4,808,112 | 2/1989 | Wood et al. | 439/66 |
| 4,862,588 | 9/1989 | MacKay | 29/884 |
| 4,875,870 | 10/1989 | Hardy et al. | 439/204 |
| 4,885,126 | 12/1989 | Polonio | 361/399 |
| 4,991,290 | 2/1991 | MacKay | 29/884 |
| 4,993,958 | 2/1991 | Trobough et al. | 439/91 |
| 5,201,883 | 4/1993 | Atoh et al. | 264/272.15 X |

FOREIGN PATENT DOCUMENTS 471259 9/1937 United Kingdom .

OTHER PUBLICATIONS

Shin-Etsu Polymer, "The Shin-Flex MAF-Connector," data sheet published prior to Dec. 1987.

Fujipoly Inc., "Connector W Series (Elastic Connectors)," vendor literature published prior to Dec. 1989.

Fulton, Lambert, Moore, and Sekutowski, "The Use of Anistropically Conductive Polymer Composites for High Density Interconnection Applications". "Proceedings of The Technical Conference-NEPCON West", vol. 1, pp. 32-46, 34 (1990 by Cahners Exposition Group).

Thomas J. Buck, "Design Considerations for Interconnecting High Performance SMT Devices," presented at 1990 Symposium, Portland, Oreg. in association with PCK Technology Division Kollmorgen Corp.

*Primary Examiner*—Carl J. Arbes

*Attorney, Agent, or Firm*—Chernoff, Vilhauer, McClung & Stenzel

[57] ABSTRACT

Connectors for attachment to cables including a large number of very small flexible conductors or conductor pairs, in which very small contacts are provided as an array exposed on a flat mating surface. Contacts may be raised slightly above the flat surface by plating conductive metal to form raised bumps on one of a pair of connectors. Individual conductors are placed through apertures defined in a substrate acting as a template, and are potted in place before shaping the mating surface of the connector. Contact bases to be plated may be defined precisely by photoresist lithography on a cover layer attached to the template substrate, and an elastomeric layer may be provided between the cover layer and the template substrate. Pin and socket combinations are used to align mating connectors with each other.

16 Claims, 23 Drawing Sheets

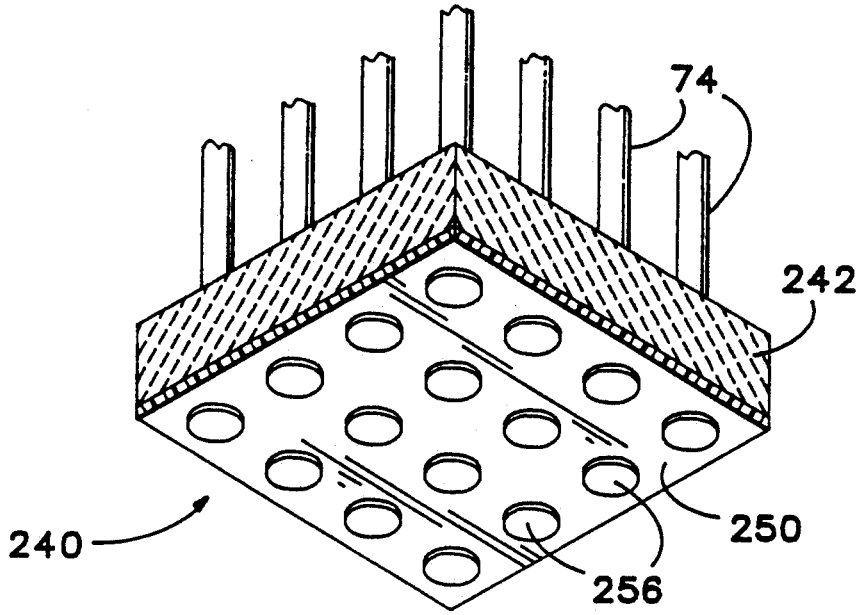
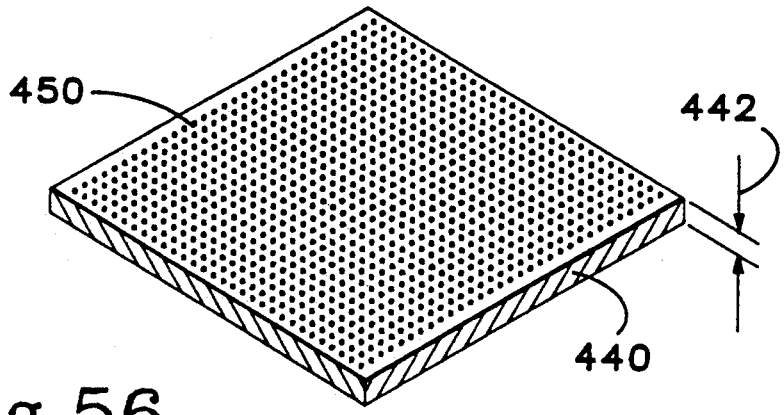
Fig. 56
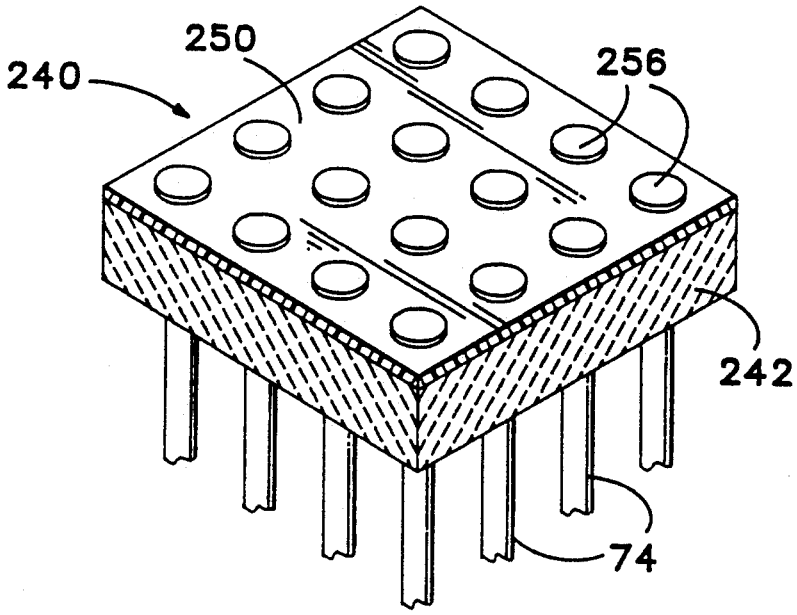

METHOD OF MAKING CONNECTOR WITH MONOLITHIC MULTI-CONTACT ARRAY

BACKGROUND OF THE INVENTION

The present invention relates to electrical interconnection of multi-conductor cables for high-frequency signal transmission, and to economically produced connectors of minimal size for accomplishing such interconnection.

Electrical cables for high-frequency signal transmission may contain many conductors, either as single unshielded conductors, or coaxial conductor pairs, with these conductors arranged in dense patterns such as concentric generally circular layers of conductors or coaxial pairs. Such cables may have more than one thousand of such conductors or conductor pairs. It is desirable to interconnect such multi-conductor cables with a maximum contact density, in order to provide the smallest practical connector size, so that the connectors do not make otherwise convenient cables clumsy to use or cause significant problems related to conductor impedances. Reliable, yet conveniently small connectors for multi-conductor cables are important, for example, in such applications as the provision of electrical connections between signal processing and display portions of medical electronic equipment and other portions of such medical electronic equipment, such as in connecting cables to sensor heads which must be easily movable about the body of a patient. Because of the large number of conductors to be connected it is also desirable for connection of each separate conductor to require only a very small force, so that the total force required for a connection is not too great.

Another factor in the construction of such multi-conductor cable connectors is that the connectors must not provide avenues for significant electrical signal interference among the various conductors of the cables being connected.

It is also important to maintain a controlled impedance through such cable connectors, and for the connectors to be durable enough to withstand repeated connection and disconnection while still providing reliable electrical connection for each of the many conductors of the cable being connected.

Commonly used pin-and-socket connectors for multi-conductor cables are either undesirably large or else very costly to produce. Because of their size, large pin-and-socket connectors may present a problem of impedance mismatching in high-frequency signal transmission through cables connected using such connectors. Also, pin-and-socket connectors often incur damage while being mated or separated, since it is easy to bend individual pins or sockets out of alignment, making it difficult or impossible to achieve electrical interconnection.

Multi-conductor connectors have previously included bodies defining arrayed openings to receive individual conductors, as defined in Hardy, et al., U.S. Pat. No. 4,875,870.

A block holding conductors and respective sockets in a rectangular array as part of a matched-impedance connector for joining round cable to ribbon cable is shown in Tarver U.S. Pat. No. 3,573,704.

Reardon, II, deceased, et al. U.S. Pat. No. 4,125,310 discloses a connector in which raised buttons on mating wafers provide electrical interconnection between ribbon-type cables, but there is no disclosure of how such a connector could be used practically for connecting cables with as many conductors as some cables commonly include.

MacKay U.S. Pat. Nos. 4,862,588 and 4,991,290 disclose a flexible interconnect for providing electrical connection between stacks of electronic components, but do not disclose how such an interconnect could be used for high density connection of the conductors of a multi-conductor cable.

Munro U.S. Pat. No. 3,852,878 discloses a resilient connector with high contact point density, but does not show how such a connector could be used to interconnect cables including large numbers of conductors.

British Patent No. 472,159 discloses contacts formed of precious metal wire, but does not disclose how such contacts could be provided in a high contact density as part of a connector for multi-conductor cables.

Darrow et al. U.S. Pat. No. 4,434,134 discloses the use of a substrate defining holes to receive the respective conductors of a multi-conductor cable, and connector pins cast precisely on the opposite side of the substrate in an aligned array.

Polonio U.S. Pat. No. 4,885,126 discloses the use of gold or conductive elastomeric material in an array having a high contact density, on the underside of a substrate carrying an integrated circuit chip, to connect the chip to a printed circuit on a second substrate, but there is no disclosure of how a suitable connector of similar contact density could be provided for the conductors of a multi-conductor cable.

While it is well known to form conductors extending between buried wires in a multi-layer circuit board and contact pads on the exterior surface of the circuit board by electroplating or similarly depositing conductive material in laser-formed holes, the prior art has not taught how to use such techniques for interconnecting a large number of conductors to contacts arrayed on a surface extending generally perpendicular to the length of the conductors, as in attaching a connector to a multi-conductor cable.

What is needed, then, is an improved connector and an economical method for making such a connector, for reliably and repeatably connecting and disconnecting cables containing a large number of small, closely-spaced, individual electrical conductors without requiring a large amount of force to effect connection or disconnection, and without causing unacceptable impedance changes.

SUMMARY OF THE INVENTION

The present invention overcomes the aforementioned shortcomings and disadvantages of the use of prior art connectors for interconnecting high-frequency signal transmission cables by providing a novel connector with high contact density, and a method for equipping a cable with such a connector. In a preferred embodiment the invention provides a connector having an array of closely spaced contacts situated in a plane substantially perpendicular to the length of a multi-conductor cable. A connector is made and incorporated in a cable in accordance with the present invention by providing a connector body including a template for receiving, and holding each of the individual conductors or coaxial conductor pairs of a cable in a defined compact array. Such a template may be of dielectric synthetic polymer or ceramic materials such as those well known for use as substrates for electrical connectors, or of metal, for situations where a common potential is desired for all of the shields or outer conductors of coaxial pairs.

Conductor apertures such as individual bores extending through the template are arranged in a closely spaced array and preferably extend parallel with one another, to receive terminal portions of the several conductors of the cable. The several conductors of the cable are inserted into respective ones of the apertures provided in the template, the terminal portions of the conductors thus being held in a required spatial arrangement. The conductors are then fixed securely in place, as by an adherent material such as an epoxy or other synthetic potting resin, which may be inserted into the template in liquid or paste form to fill available space surrounding the conductors, and may then be cured.

A suitable moldable material could instead be otherwise cast or molded around the conductors outside the template and hardened to hold the conductors in the desired array.

The portions of the fixed conductors extending from the template are then shaped, as by being cut to even lengths and then being lapped with successively finer abrasives, to define a joint face which is smoothed and polished to a desired shape, such as a plane, in which the conductor ends are located in a predetermined array.

In some cases selective laser machining may be performed, such as removal of portions of the template, dielectric material associated with a conductor, potting material, or a combination of these materials, in order to facilitate further steps of preparing a connector according to the invention.

Raised contacts are formed in one embodiment of the invention by electrophoretic or electrolytic deposition of conductive material, preferably including a surface coating of gold, on the exposed ends of the conductors to form small protrusions above the surface of the surrounding material.

For a cable including coaxially shielded conductor pairs, shields may be soldered to a conductive member forming a part of the connector body to provide a common potential for the shield conductors.

In some embodiments of the invention precisely located contact bases may be provided on a cover sheet attached to the polished joint face. The contact bases may be connected to the arrayed ends of the conductors by electrophoretic deposition of conductive material, by electroplating, or by placement of castable conductive materials between the conductors of the cable held in the template substrate and the contact bases, through conductor holes extending through the cover sheet.

In similar embodiments blind vias are provided in the cover sheet beneath the contact bases. The vias are filled with conductive material such as solder paste or conductive adhesive materials prior to fastening the cover sheet in place in registration with the exposed ends of the conductors of the cable.

In one embodiment of the connector, a template substrate may be of a ceramic material, machined by lasers, to provide the necessary bores to receive the several conductors.

In some embodiments of the invention several conductor carried in the form of conductive flexible circuit traces on a flexible dielectric base are placed through a single slot aperture in the template, with several such slot apertures being provided parallel with each other in the template, and individual conductors or conductor pairs are connected with the flex circuit conductive traces.

It is therefore a principal object of the invention to provide for in-line, or straight-through, interconnection of an electrical cable including a very large number of conductors in a minimum amount of space It is another important object of the present invention to provide an improved low mating force cable connector for reliable controlled-impedance connecting of large numbers of conductors for carrying high-frequency electrical signals.

An important feature of the present invention is that it provides a precisely defined array of closely-spaced contacts each connected to an individual conductor of a multi-conductor cable.

A further feature of one embodiment of the invention is the provision of a cushioning layer of compressible elastomeric material supporting the contacts of the connector.

An advantage of the present invention is that it permits greater contact density than has previously been available in connectors to join multi-conductor cables, making it possible to construct a connector of smaller size than has previously been possible.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 51 is a perspective view of a connector which is yet a further embodiment of the present invention.

FIG. 56 is a perspective view showing the utilization of an anisotropic elastomeric connector sheet in association with a connector assembly according to the invention.

DETAILED DESCRIPTION OF THE DRAWINGS

Figure 1:
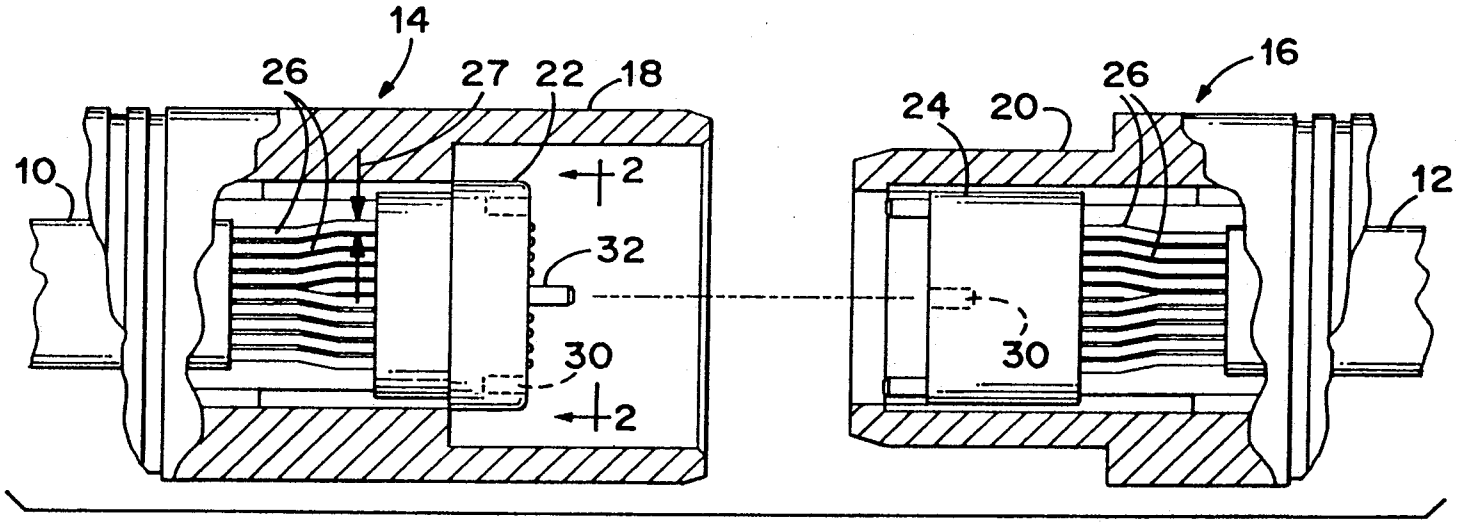
FIG. 1 is a partially cut-away side view of portions of a pair of cables each equipped with one of a pair of mating connectors according to the present invention.
Figure 2:
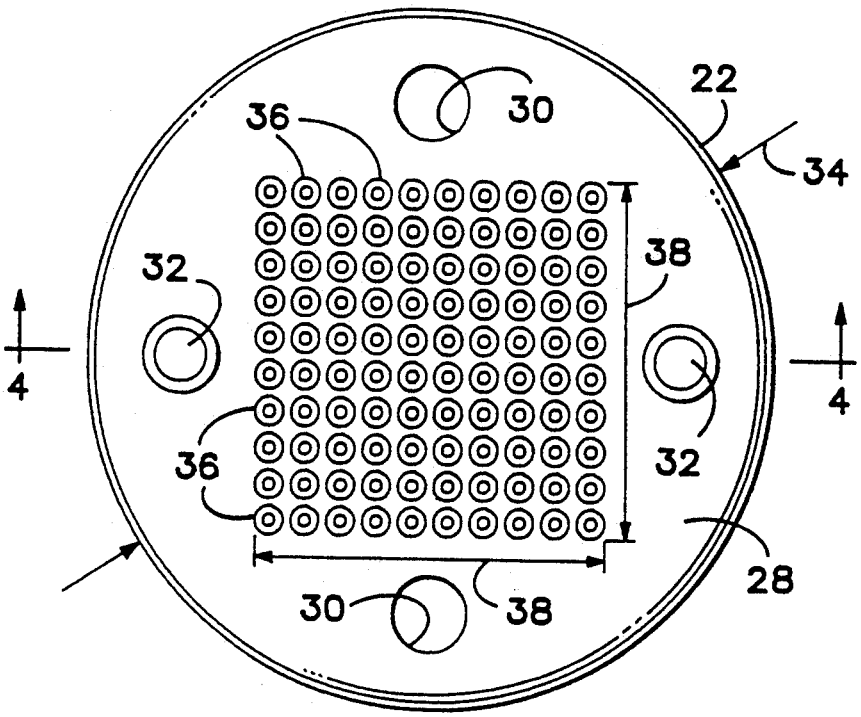
FIG. 2 is a view of a portion of one of the connectors shown in FIG. 1, taken along line 2—2, at an enlarged scale.

Referring now to the drawings, in FIG. 1 a pair of cables 10, 12 are equipped with mating connectors 14, 16 embodying the present invention. The connector 14 has a female housing 18, and the connector 16 includes a male housing 20. Within the housings 18, 20, respective connector bodies 22, 24 are connected to the various electrical conductors 26 included in the cables 10, 12. A typical cable 10 or 12 may have 60–150 conductors each having a diameter 27 of about 0.38 mm (0.015 inch), including an insulating jacket of dielectric material.

As shown in FIGS. 2–5, the connector body 22 is generally cylindrical and has a planar mating surface 28. The body 22 has a pair of locator pin receptacles 30 defined in the mating surface 28 at locations opposite one another, and a pair of locator pins 32 are mounted in the body 24, attached by an adhesive and projecting from the mating surface 28 at corresponding positions spaced equally distant from each of the locator pin receptacles 30, as shown, although the locations of the locator pin receptacles 30 and locator pins 32 could be such as to permit the body 22 to mate with the body 24 only in a unique orientation. It will also be appreciated that locator pins and receptacles could be provided in the housings 18, 20 instead in order to avoid force concentrations in the material of the body 22.

The body 22 may have a diameter 34 of 12.7 mm (0.5 inch), for example. Located on the mating surface 28 in a rectangular array are one hundred closely-spaced contacts 36, each corresponding to one of the conductors 26 of the cable 10. The contacts 36 are spaced on 0.635 mm (0.025 inch) centers, so that the array of contacts 36 defines a square whose sides have a length 38 of 6.215 mm (0.244 inch).

The body 22 may be made, for example, of a glass-filled moldable resin such as that available from the General Electric Company under the trademark ULTEM, or of a ceramic dielectric material such as an alumina having a satisfactory dielectric constant. The body 22 may have a thickness 40, measured in the direction axial of the cylindrical shape of the body 22, of about 6.35 mm (0.25 inch).

Figure 3:
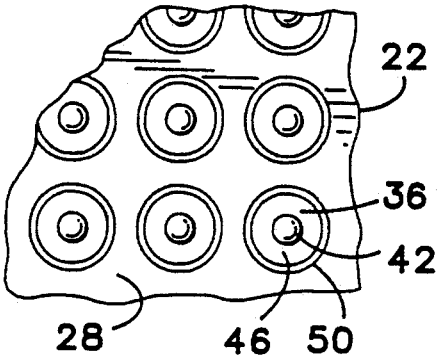
FIG. 3 is a detail view, at a further enlarged scale, showing some of the contacts of the array included on the face of the connector body shown in FIG. 2.
Figure 4:
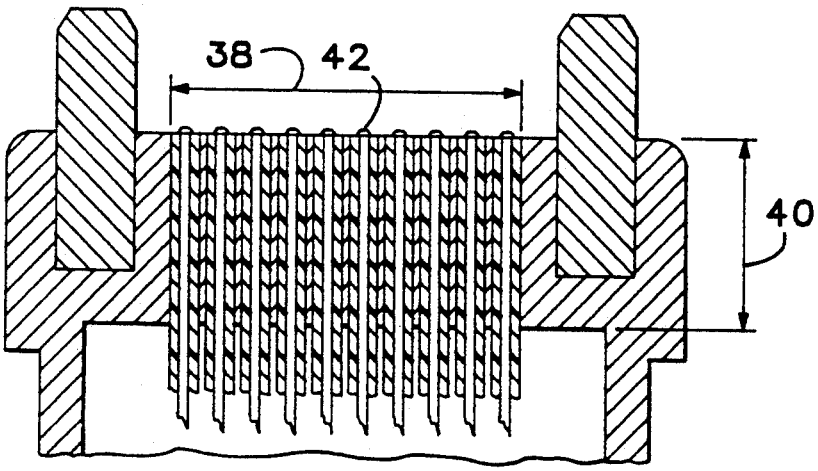
FIG. 4 is a sectional view of the connector body template shown in FIG. 2, taken along the line 4—4.
Figure 5:
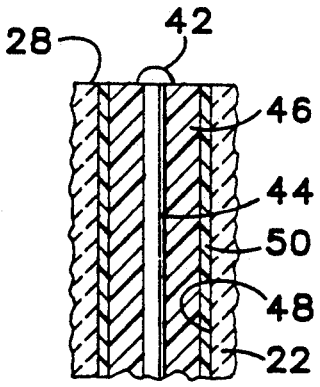
FIG. 5 is a view at an enlarged scale showing a detail of the template element shown in FIGS. 2 and 4.

As is shown in FIGS. 3–5, each contact 36 includes a raised portion 42 standing proud above the mating surface 28. The raised portions 42 are preferably of a highly conductive material such as a metal deposited by an electroplating process, and may be of gold, for example, or may have a gold outer layer to provide conductivity together with resistance to corrosion.

A terminal portion 44 of the central electrical conductor 26 is surrounded by a layer 46 of dielectric material extending through a respective conductor aperture 48 in the form of a bore defined by the body 22, and a layer of a non-conductive potting material 50 surrounds the conductor 44 and the layer 46 of dielectric to retain it in the conductor aperture 48. The potting material may, for example, be an epoxy resin material which flows with a low viscosity and good wetting capability before curing, to fill all the available space between the dielectric material 46 and the interior surface of the conductor aperture 48. The potting material 50 may also preferably penetrate into any interstices resulting from the porosity of the dielectric material 46, which may, for example, be of an expanded polytetrafluoroethylene material. A material such as UV- or heat-curable acrylic/urethane mixture such as that produced under the trademark Loctite 370 by Loctite Corporation of Newington, Connecticut has been found satisfactory as a potting material.

The conductor apertures 48 are arranged in the body 22 so that a portion of the body 22 is a template for receiving a terminal portion of each of the electrical conductors 26, and a respective conductor aperture 48 is defined for each of the electrical conductors 26 of the cable 10. The conductor apertures 48 are spaced in each row at 0.635 mm (0.025 inch) center-to-center, and have a diameter of 0.305–0.330 mm (0.012–0.013 inch) for conductors 26 whose diameter is 0.279 mm (0.011 inch), including the layer 46 of dielectric material.

Referring now particularly to FIGS. 6–9, the connector 14 is prepared and connected to the cable 10 in accordance with the method of the present invention by providing a body 22 molded by conventional techniques and including the conductor apertures 48 defining a template for receiving the terminal portions 44 of the several insulated conductors 26.

Figure 6:
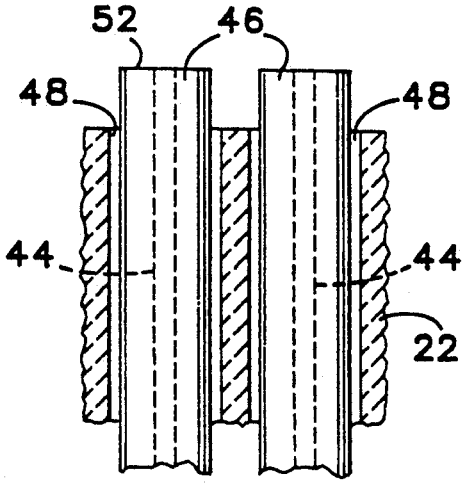
FIG. 6 is a sectional view of a detail of a template element of a connector body, together with a pair of conductor elements of a cable, showing a first step in preparing such a connector according to the method of the invention and connecting it to a cable.
Figure 7:
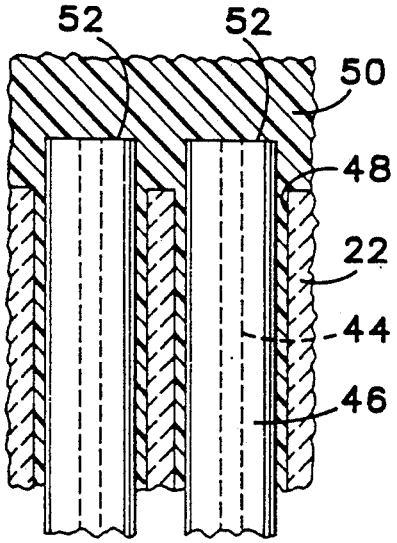
FIG. 7 is a view similar to that of FIG. 6, showing a further step in the process of preparing such a connector in accordance with the present invention and connecting it to a cable.
Figure 8:
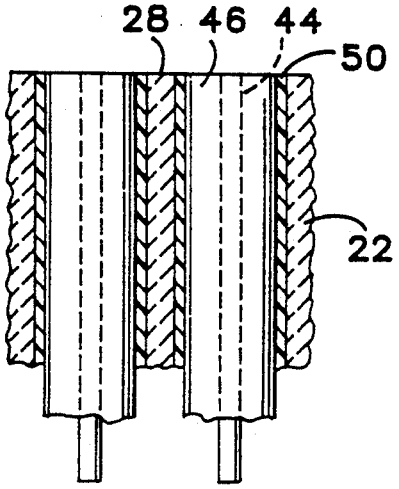
FIG. 8 is a partially schematic view similar to those of FIGS. 6 and 7, showing a further step in the process of preparing a connector in accordance with the present invention.
Figure 9:
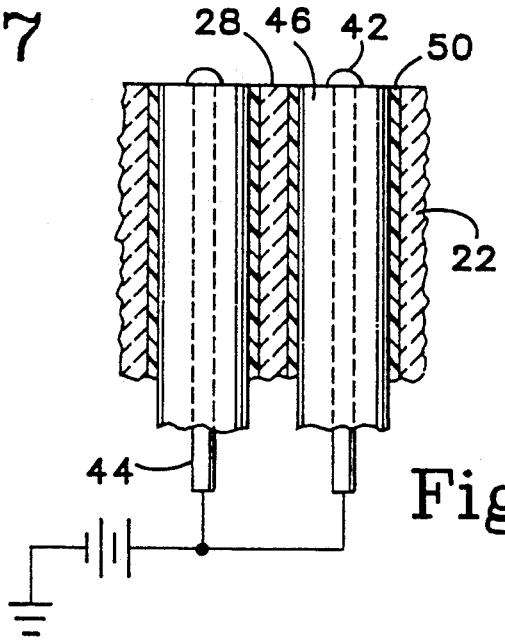
FIG. 9 is a partially schematic view of yet a further step in the process of preparing a connector according to the present invention.

As shown in FIG. 6, each terminal portion 44 is inserted through a respective one of the conductor apertures 48. When all of the conductors have been inserted they are fixed in place, as by applying a quantity of potting material 50 in a liquid form, surrounding the ends 52 of the conductors 26 and extending downwardly into the conductor apertures 48 and into the material of the layer 46 of dielectric material, and then curing the potting material 50 into a rigid form. Once the potting material 50 has cured the portions of the conductors 26 are cut off close to the body 26, as by a diamond saw, for example, and the potting material 50 is ground away, together with the protruding ends 52 of the several conductors 26, to the surface of the body 22 to form a generally planar surface which is then lapped and polished, using successively finer grit and ultimately utilizing polishing techniques which are well known, for example, in polishing the ends of optical fibers for making interconnections. This leaves end faces of the terminal portions 44 of the conductors 26 exposed, and the raised portions 42 are then formed by electroplating a quantity of conductive material such as gold onto the end faces, using known electroplating techniques, as is indicated schematically in FIG. 9.

The connector body 24 is connected similarly to the conductors 26 of the cable 12. Once the mating surface 28 has been shaped flat and polished, however, manufacture of the connector body 24 is complete, except for optionally providing a plating on the end faces of terminal portion 44 of the conductors 26 sufficient to resist corrosion. The mating face 28 thus remains as a substantially flat surface to be contacted by the raised portions 42 of the contacts 36. The contacts thus provided in the connector body 24 are available to receive electrical contact through pressure exerted by the raised portions 42 of the contacts 36.

Figure 10:
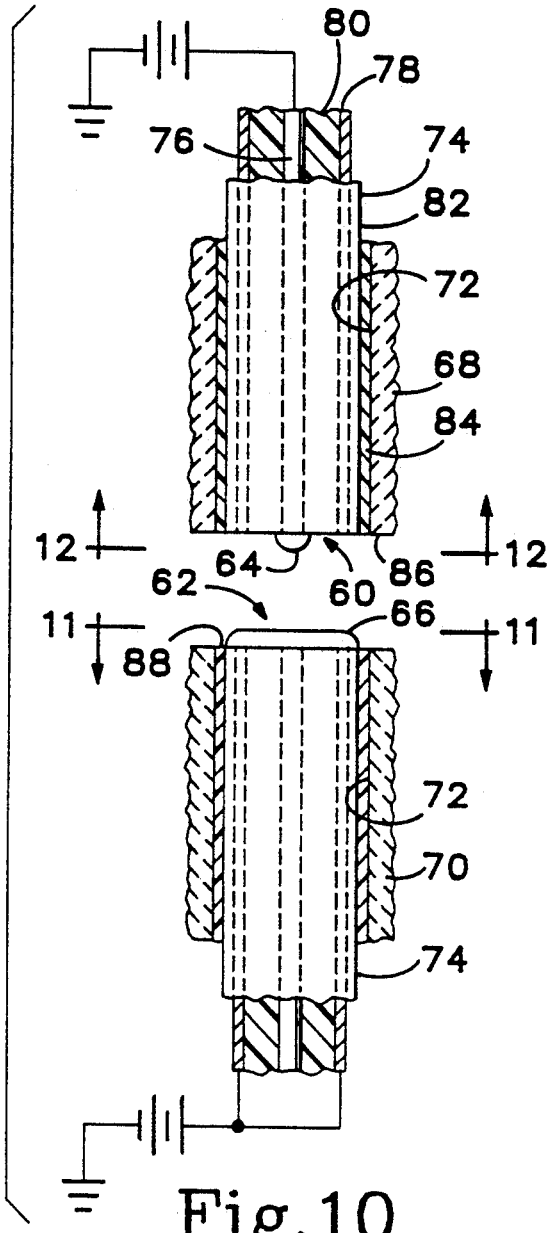
FIG. 10 is a partially schematic view showing the manner of electrical connection to coaxial conductors which is part of a process of preparing raised contacts for a connector according to the present invention.
Figure 11:
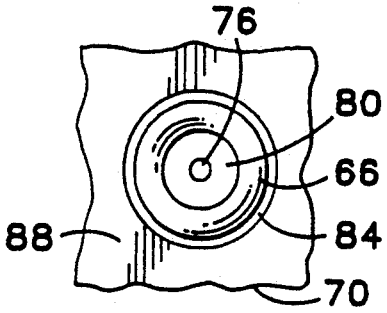
FIG. 11 is a view taken in the direction indicated by the line 11—11 in FIG. 10, showing a raised annular contact corresponding to the shield conductor of a coaxial conductor pair for one of the mating pair of connector elements shown in FIG. 10.
Figure 12:
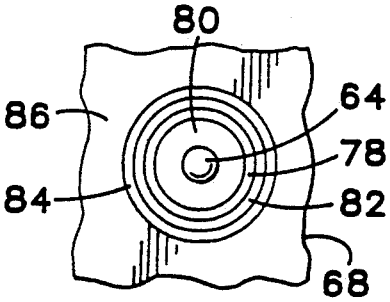
FIG. 12 is a view taken in the direction indicated by the line 12—12 of FIG. 10, showing a raised contact corresponding to the center conductor of a coaxial conductor pair in a second one of the mating pair of connector elements of the pair shown in FIG. 10.

Connectors 60, 62 according to the present invention, shown in FIGS. 10, 11, and 12, are of similar structure and appearance and similarly include a large number of individual contacts 64, 66, for coaxial conductor pairs 74 of a multi-conductor cable, or for interconnection to portions of a circuit through the use of a large number of separate coaxial conductor pairs. The bodies of the connectors 60 and 62, of which only very small portions are shown in FIGS. 10–12, include template substrates 68 and 70 each defining an array of conductor apertures 72 holding conductor pairs 74.

The connectors 60, 62 are prepared in a fashion basically similar to that used in connection with the connectors 14 and 16. Individual coaxial conductor pairs 74 each include a central conductor 76, a shield conductor 78 disposed coaxially about the central conductor 76, an intermediate layer 80 of dielectric material and an outer layer 82 of dielectric material. Each of the individual coaxial conductor pairs 74, including the dielectric layers, is inserted into a respective one of the conductor apertures 72, and a quantity of potting material 84 similar to the potting material 50 is applied to surround the conductor pairs 74 and fill the available space within the conductor apertures 72, including any available spaces defined by the layers 80 and 82 of dielectric material.

The potting material 84 is cured, and flat mating surfaces 86, 88 are then formed by lapping and polishing the potting material and conductors, as described above in connection with the mating surface 28 of the connector body 22. Thereafter, the circular center contact 64 is built up relative to the mating face 86 in electrical contact with the central conductor 76, as by electroplating as described above in connection with the previously described embodiment of the invention. Similarly, an annular contact 66 is built up relative to the mating face 88 in electrical contact with the shield conductor 78 to define a raised portion as shown in FIGS. 10 and 11. Ordinarily, the raised central contact 64 would be provided for all of the conductor pairs of the connector 60. A raised annular contact 66 would be provided similarly for all of the conductor pairs on the mating connector 62, while the other portions of the mating surfaces 86 and 88 remain as a flat polished surface including flat contact portions available to be contacted electrically by the raised contact portions 64, 66 of the mating connectors. As with connector 24 the flat contact portions of both of the connectors 60, 62 may be plated to a minimum thickness to resist corrosion.

Figure 13:
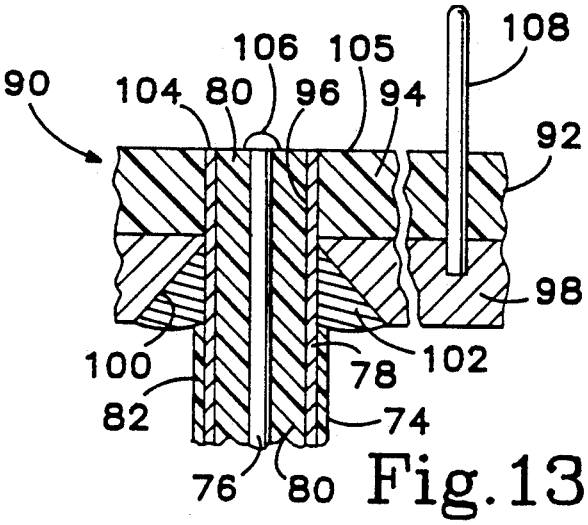
FIG. 13 is a sectional view showing a detail of a template portion of a connector having a two-layer construction in which a lower layer provides a common electrical potential to which a shield conductor of a coaxial pair is connected in accordance with the present invention.

In another embodiment of the invention, shown in FIG. 13, a coaxial conductor pair 74 is connected with a corresponding conductor pair through a connector 90. A connector body 92 includes a template substrate 94 of a dielectric material such as a ceramic or molded plastic material as previously described, defining a plurality of closely spaced conductor apertures 96 in the form of bores. Attached to a rear face of the template substrate 94, as by an adhesive (not shown), is a common or back layer 98 such as a metallic foil or a coating of electrically conductive material, such as a two-component conductive epoxy available from Zymet, Inc. of East Hanover, N.J., under the trademark Zymet SLT-03, defining conductor apertures 100 corresponding with the locations of the conductor apertures 96. Each conductor pair 74 is attached to the connector body 92 by stripping back a terminal portion of the outer dielectric layer 82 to expose the shield conductor 78, which is then electrically connected to the common or conductive back layer 98, as by a conductive adhesive or by solder 102, preferably by applying the conductive adhesive or solder paste to one row or layer of conductor pairs 74 before inserting another row or layer into the conductor apertures 96. The central conductors 76 and the intermediate layer 80 of dielectric material extend beyond the shield conductor 78 and are held in place within the conductor apertures 96 defined in the template 94 by a quantity of potting material 104 preferably applied from the front of the substrate 94. The cured potting material 104 and exposed portions of the conductor pairs 74 are then shaped and polished to form a mating face 105, after which a raised center contact 106 is formed in contact with the center conductor 76, as by the previously-described electroplating methods. An alignment pin 108 is fastened in the body 92 by an adhesive, to mate with a receptacle provided in a mating connector (not shown).

Figure 15:
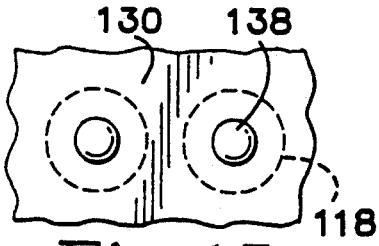
FIG. 15 is a view taken in the direction indicated by the line 15—15, showing two of the raised contact members of the connector shown in FIG. 14.
Figure 14:
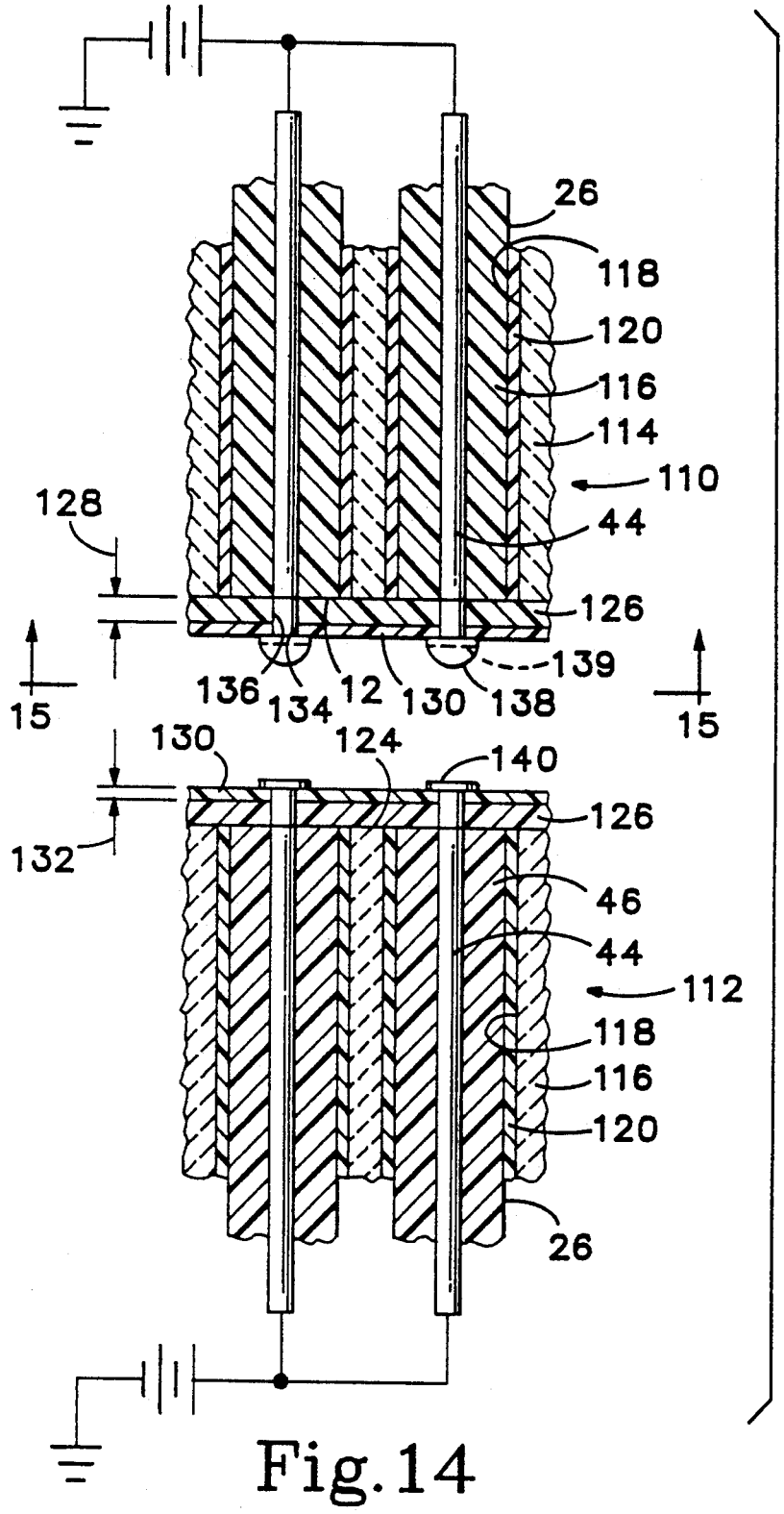
FIG. 14 is a partially schematic sectional detail view showing the structure of a mating pair of multi-layered connectors, with a pair of unshielded conductors attached thereto for interconnection according to the present invention.

In a further embodiment of the invention, shown in FIGS. 14 and 15, a mating pair of connectors 110, 112 for connecting unshielded conductors 26 include templates in the form of template substrates 114, 116, respectively, each defining respective conductor apertures 118 within which the terminal portions 44 of the conductors 26, including their layers 46 of dielectric material, are securely held by potting material 120. Joint faces 122, 124 are prepared respectively on the template substrates 114, 116 after the conductors 26 have been secured in place by the potting material 120, by lapping and polishing as described previously in connection with the mating surfaces 28 of the connector 14. On the joint surfaces 122 and 124 a pair of layers are attached by layers of adhesive materials (not shown). A first layer 126 is of an elastomeric dielectric material, such as a silicone rubber sheet, having a thickness 128 of about 0.050–0.125 mm (0.002–0.005 inch), for example, and a second layer or cover sheet 130 is of a tough flexible polymeric dielectric such as polyethylene or a polyimide available from E. I. duPont de Nemours & Company of Wilmington, Del., under the trademark Kapton TM, and has a thickness 132 of 0.05–0.25 mm (0.002–0.010 inch). Adhesives for laminating such polyimide to the silicone rubber include RTV adhesives available from Dow Corning of Midland, Michigan, under the trademark Silicone 340. The layers of elastomeric material 126 and polymeric material 130 define conductor holes 134, 136, respectively, which may be made by conventional techniques such as the use of lasers, and which are located precisely in an array corresponding with the ideal locations of the end faces of the terminal portions 44 of the conductors 26, exposing the terminal portions 44 for connection of the contacts 138, 140 thereto.

The contacts 138 and 140 may be built up by electroplating conductive material onto the exposed surfaces of the terminal portions 44 of the conductors 26, or by filling the conductor holes 134, 136 with a conductive adhesive or castable material, such as a doped epoxy, which is thereafter cured. Preferably, however, contact bases 139 are provided, precisely located on the cover sheet 130, by conventional methods of flex circuit production, including photo-resist mask-defined etching of a metal foil layer laminated onto the flexible dielectric material, and the contacts 138, 140 may be increased in height as shown by additional conductive material electroplated on these contact bases.

Figure 16:
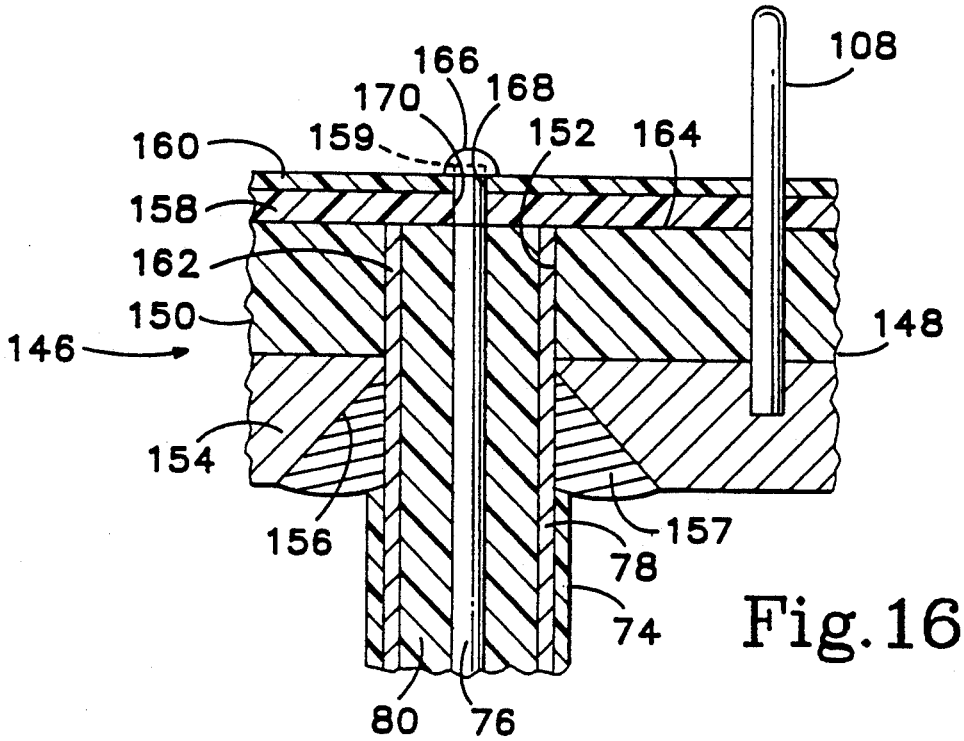
FIG. 16 is a sectional view of a detail of a multi-layered connector according to the present invention for connecting a cable made up of a plurality of coaxial conductor pairs.

Multiple coaxial conductor pairs 74 can be connected with a common potential for all of the shield conductors 78 by a connector 146 according to the present invention, as shown in FIG. 16. The connector 146 is similar in its basic construction to the connector 90, with a body 148 including a template substrate 150 defining respective conductor apertures 152 for all of the conductor pairs 74 to be connected. A conductive back, or common, layer 154 defining correspondingly located conductor apertures 156 is securely fastened to the substrate 150, as by an adhesive (not shown), with the conductor apertures 152 and 156 precisely aligned with one another. Each shield conductor 78 is connected electrically to the back, or common, layer 154 as by solder 157.

The central conductor 76, together with the intermediate layer 80 of dielectric material of each coaxial pair 74, extends through the template substrate 150, being held in place within the respective conductor aperture 152 by potting material 162. A polished, planar joint face 164 is prepared, after the potting material 162 has cured, by lapping and polishing as has been previously described with respect to the mating face 28 and the joint faces 102, 124. A pair of layers of dielectric material, a first layer 158 of an elastomeric material similar to the layer 126 (FIG. 14), and a cover sheet 160 similar to the cover layer 130, are adhesively attached to the joint face 164 on the template substrate 150.

A respective contact 166 is located precisely on the cover layer 160, communicating with the end of the central conductor 76, which is exposed through conductor holes 168 and 170 defined respectively in the cover layer 160 and the elastomeric layer 158 prior to attachment of the elastomeric layer 158 and cover layer 160 to the template substrate 150. The contact 166 may be formed on a contact base 159 by the same methods used to form the contacts 138 and 140 as previously described.

Figure 18:
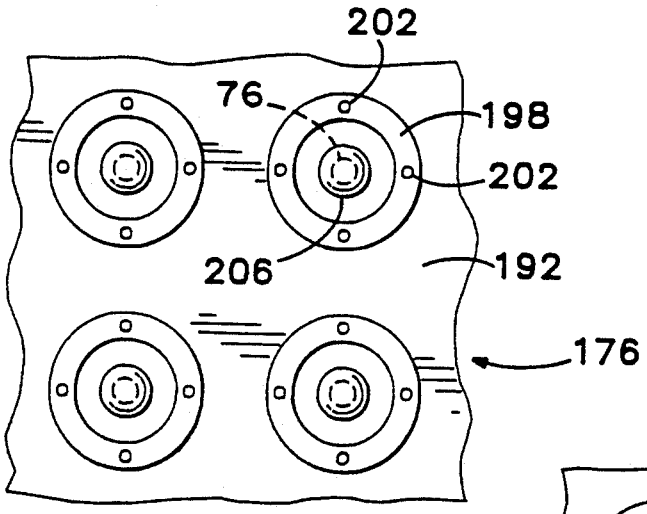
FIG. 18 is a view of a portion of a face of one of the connectors shown in FIG. 17, taken in the direction indicate by the line 18—18.
Figure 19:
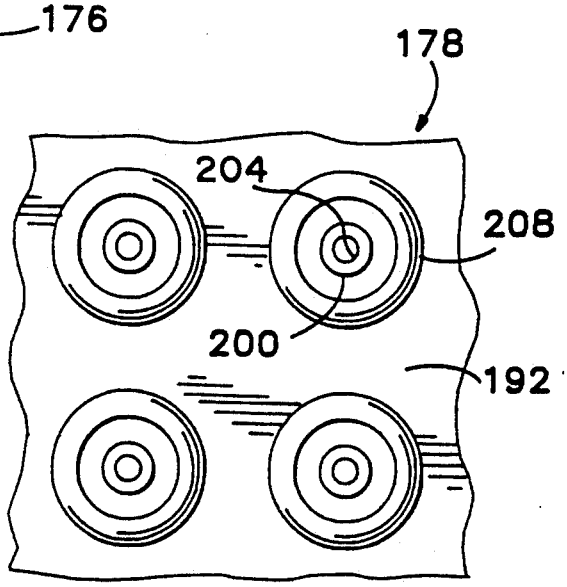
FIG. 19 is a view of a portion of a face of one of the connectors shown in FIG. 17, taken in the direction indicated by the line 19—19.
Figure 17:
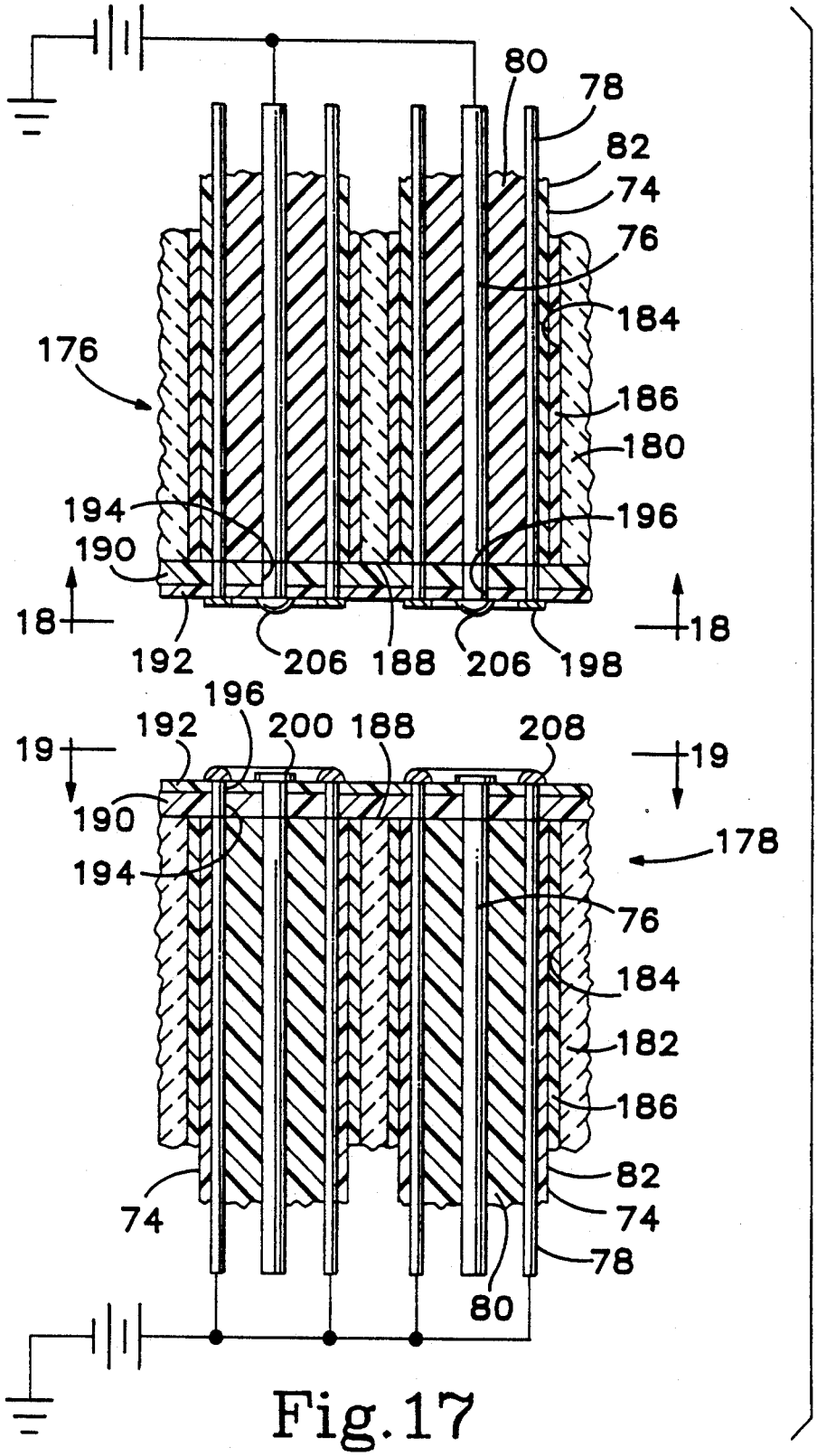
FIG. 17 is a view similar to that of FIG. 14, showing a pair of connectors of multi-layered structure according to the present invention for connecting multiple coaxial pairs of conductors.

Referring next to FIGS. 17, 18 and 19, a pair of mating connectors 176, 178 also provide for simultaneously connecting large numbers of coaxial conductor pairs 74 such as those of a cable. The connectors 176, 178 include bodies having, respectively, template substrates 180, 182, with coaxial conductor pairs 74 being held in respective conductor apertures 184 by potting material 186 as described previously with respect to other embodiments of the invention. Each of the template substrates 180, 182 defines a respective joint surface 188, prepared by lapping and polishing after the potting material 186 has been cured. A layer 190 of elastomeric material similar to the previously described layer 126 (FIG. 14), and a cover layer 192 of flexible dielectric material such as a polyimide, respectively defining conductor holes 194, 196, are attached to the joint surfaces 188 and to each other by adhesive materials (not shown).

An annular contact base 198 and a smaller circular contact base 200, located within each annular contact base 198, are provided on the cover layers 192. As may be seen better in FIGS. 18 and 19, openings 202 and 204 are defined, respectively, in the contact bases 198 and 200. Hemispherical contacts 206 and annular contacts 208 are optionally formed as shown on the contact bases 200 and 198, respectively, by electroplating, as indicated in FIG. 17. Deposition of electroplated material proceeds beginning on the exposed surfaces of the central conductor 76 and shield conductor 78, and is continued until sufficient conductive material is deposited in the conductor holes 194, 196, and openings 202, and 204 of the opposite contact bases of each of the connectors 176, 178, to connect the contact bases 198 and 200, respectively, to the associated shield conductor 78 or central conductor 76. Connection between the contact bases 198 and 200 and the conductors 76 or 78 may, instead, be accomplished by the use of conductive materials cured in the conductor holes 194, 196, or by application and reflow of solder paste in the conductor holes.

When the connector 176 is mated with the connector 178, the circular contacts 206 are aligned with and come into contact with the contact bases 200, while the annular contacts 208 are brought into contact with the surfaces of the contact bases 198. The layers 190 of elastomeric material allow some local compression associated with individual contacts 206 and 208 to assure that each contact is pressed against the opposite contact base with sufficient pressure to maintain electrical connection between the connectors 176 and 178.

Figure 21:
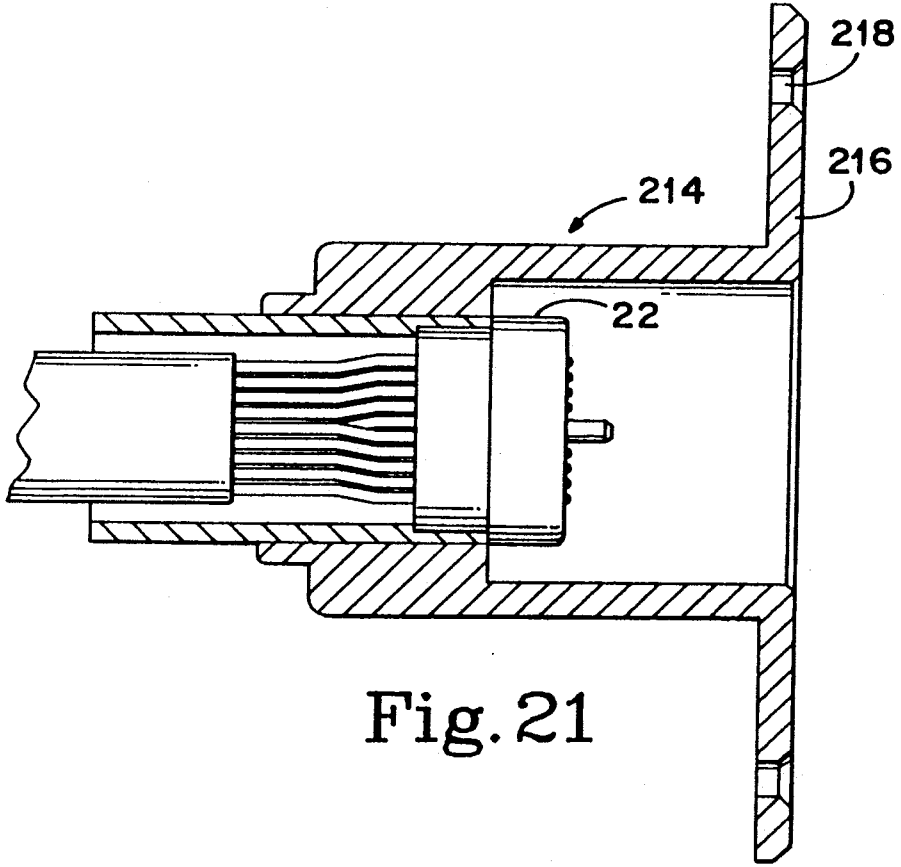
FIG. 21 is a sectional view of the connector shown in FIG. 20, taken along line 21—21.
Figure 20:
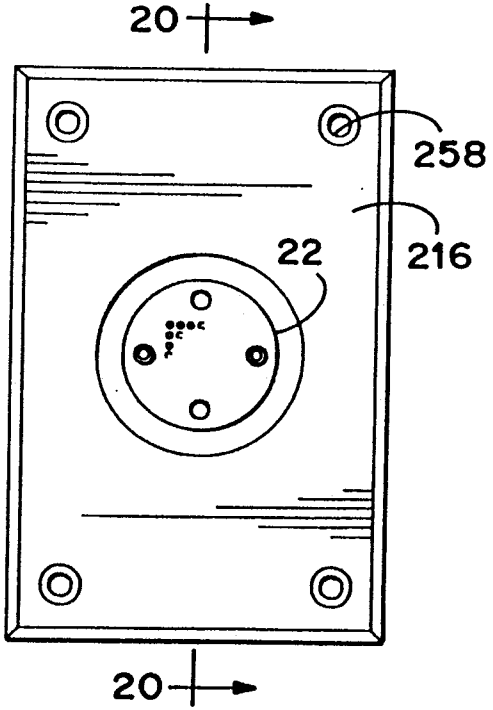
FIG. 20 is a front view of a connector according to the present invention adapted to be mounted in a housing for an electronic equipment to receive a mating connector associated with an end of a cable.

A connector 214, shown in FIGS. 20 and 21, is similar to the connector 14, except that it includes a flange 216 defining holes 218 useful to mount the connector 214 to receive a removable cable equipped with a connector such as the connector 16 shown in FIG. 1.

Figure 22:
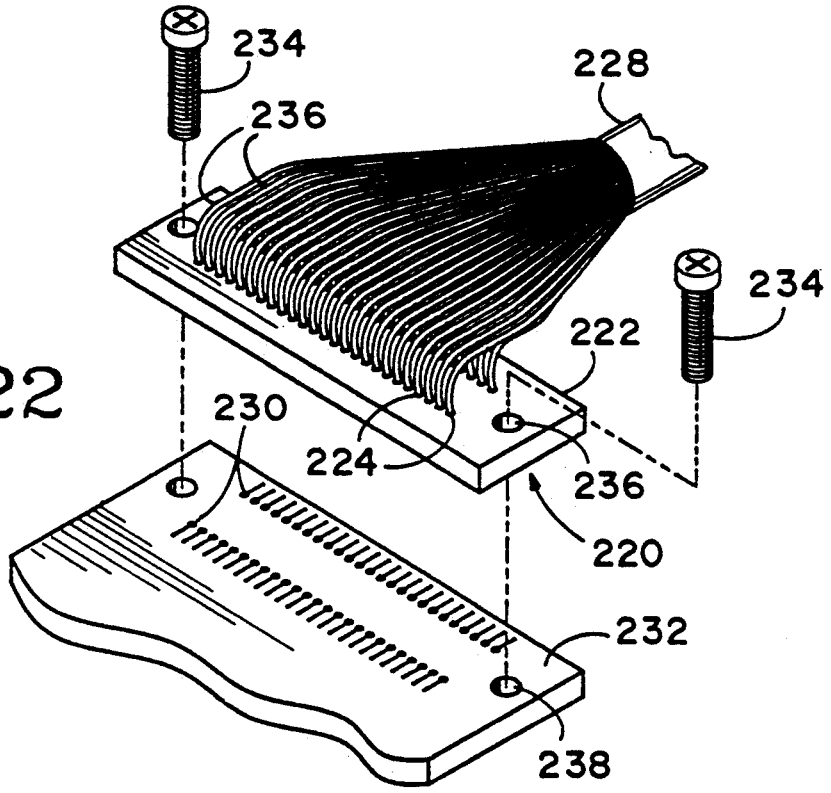
FIG. 22 is a view of an end of a multi-conductor cable equipped with a connector according to the invention, together with a portion of a printed circuit board.

The concept of the present invention is also embodied in the generally rectangular connector 220, shown in FIG. 22, in which a substrate template 222 includes conductor apertures 224 arranged in a pair of rows extending parallel with one another along the length of the template substrate 222. The various individual insulated conductors 226 of a cable 228 may be installed in the template 222 as described above in connection with one of the previously-described connectors, to provide an array of contacts (not shown) in two parallel rows on a flat mating face on the underside of the template 222 as it is shown in FIG. 22. Mating contacts 230 are provided on circuit element 232, which may be a printed circuit or a flex circuit, and the connector 220 is held in alignment with the circuit element 232 by fasteners such as screws 234 extending through alignment holes 236 and 238 defined, respectively, in the template 222 and the circuit element 232.

Figure 23:
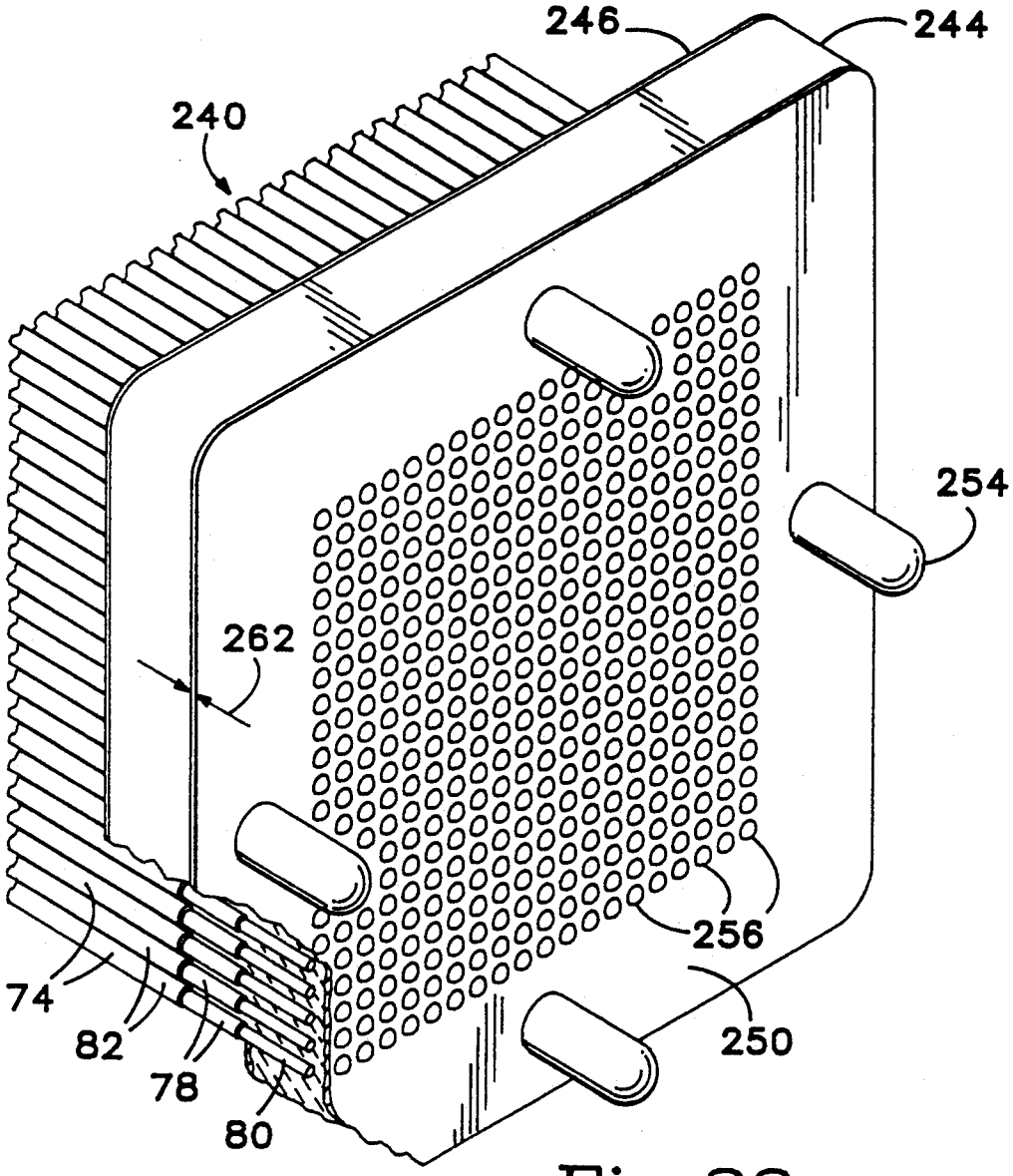
FIG. 23 is a perspective view of a connector according to the present invention for interconnecting multiple coaxial conductor pairs, including a common conductor layer for interconnecting shield conductors of the coaxial conductor pairs.

In a further embodiment of the invention, a connector 240 shown in FIG. 23 may be used for interconnection of up to 440 coaxial pairs 74. The connector 240 includes a template substrate 242, which may be of molded plastic or a machinable ceramic material, as part of its body 244. A common potential is established for the shield conductors 78 by a conductive common layer such as a metallic foil layer 246 adhesively attached as a backing on the substrate 242. Conductor apertures 248 may be provided on spacing at least as close as 0.635 mm (0.025 inch), center-to-center, in a rectangular array of 22 rows, each including 20 conductor apertures 248, and a similar number of contacts 256 are provided in a precise array on a mating surface 266 of a cover sheet 250 similar to the cover sheet 130 described previously. Conductor apertures 248 may, for example, have a diameter of about 0.33 mm (0.013 inch), and each of the contacts 256 may have a diameter of approximately 0.38 mm (0.015 inch).

Figure 24:
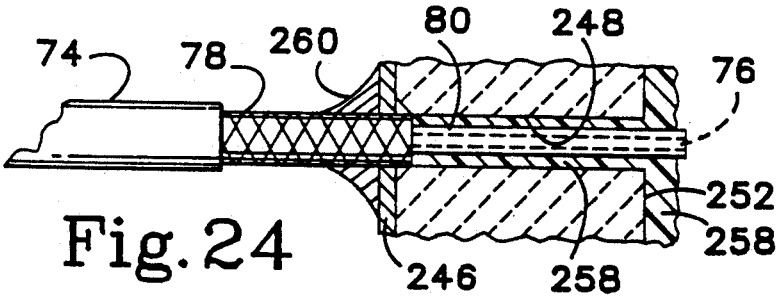
FIG. 24 is a sectional view of a detail of a connector similar to that shown in FIG. 23 at one stage during its assembly, showing one step of the process of preparing such a conductor and connecting it to the coaxial conductor pairs of a cable.
Figure 25:
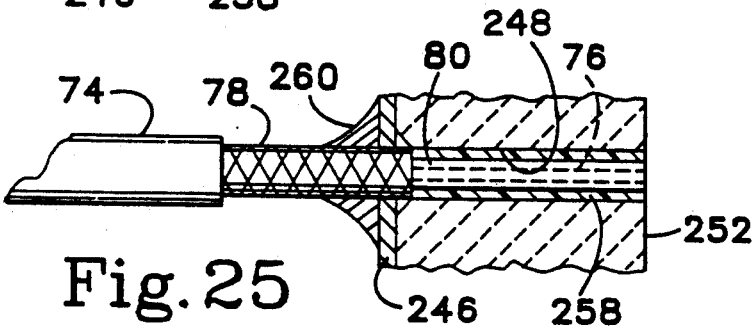
FIG. 25 is a view similar to that of FIG. 24, showing a further stage of the process of preparing and connecting such a connector such as the one shown in FIG. 23.
Figure 26:
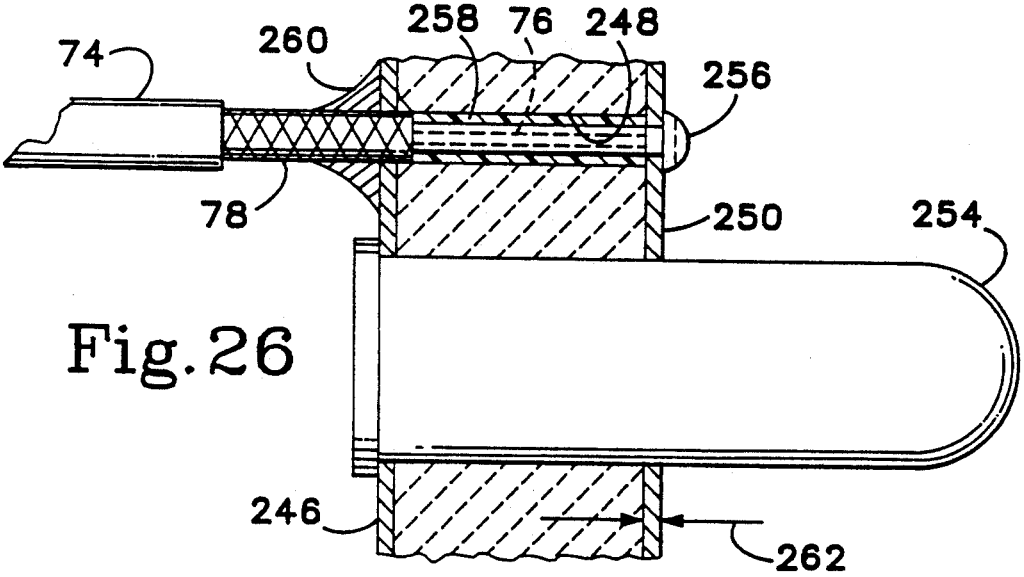
FIG. 26 is a view similar to FIG. 24, showing a final stage of preparation of a connector such as the one shown in FIG. 23.
Figure 27:
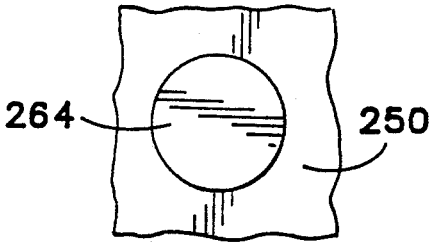
FIG. 27 is a front view of one type of contact base for use on a cover sheet of a connector such as that shown in FIGS. 23-26.

The connector 240 is prepared and connected to the individual coaxial conductor pairs 74, as shown in FIGS. 24, 25, and 26, by first attaching the foil layer 246 or a suitable conductive coating to the back of the substrate 242, with the respective conductor apertures 248 properly aligned. Preferably, each of the conductor apertures 248 is chamfered on the back side of the substrate 242, as shown, to receive a short portion of the shield conductor 78, trimmed back to permit a terminal portion of the central conductor 76 together with the intermediate dielectric material 80, to extend through the conductor aperture 248. The shield conductors 78 are soldered to the foil 246, preferably by use of a solder paste which is heated once all of the conductor pairs have been inserted through the substrate template 242. When all of the conductor pairs 74 have been inserted through the conductor apertures 248 defined in the substrate template 242, and the shield conductors have been soldered to the foil 246, a quantity of a potting material 258 is applied to the front face of the substrate template 242, to fasten the intermediate dielectric material 80 and the central conductors 76 in place in the conductor apertures 248. When the potting material 258 has cured the potting material 258 and the exposed terminal portions of the intermediate dielectric layers 80 and the central conductors 76 are ground and polished flat, together with the template substrate 242, to form a joint surface 252.

The cover sheet 250 is attached to the joint surface 252, and has a thickness 262 which may range from about 0.05–0.25 mm (0.002–0.010 inch), depending upon factors including the amount of resiliency desired.

Referring now also to FIGS. 27, 28, 29, and 30, each of the contacts 256 may be formed on a contact base 264 or 265 located on the outer, or mating face 266 of the cover sheet 250, formed by a conventional lamination and photoresist etching process leaving a pattern of precisely located contact bases 264 or 270 of conductive metal foil securely attached to the polyimide material of the cover sheet 250.

In order to interconnect the contacts 256 to the central conductors 76, once the contact bases 264 have been defined on the cover sheet 250, a blind via 268 is produced through the cover sheet material behind each of the circular contact bases 264 by removing some of the cover sheet material, as by the use of a laser, exposing the underside of each contact base 264. In particular, it has been found that use of an ultraviolet laser produces satisfactory results, by causing a photodecomposition of the polyimide material of the cover sheet 250, leaving a well-defined opening through the polyimide material without leaving contaminating residue and without burning through the contact base 264, when appropriate power levels are used.

The blind vias 268 are filled with a curable conductive paste material such as an epoxy, or with a solder paste, after which the cover sheet 250 is placed against the joint surface 252, properly aligned with the template substrate 242. Thereafter, the conductive paste and adhesive are cured or the solder is reflowed to complete the connection between the contact base 264 and the respective central conductor 76 for each contact 256. If solder paste is used, the solder may be reflowed by infrared radiation or by application of hot air without damage to the cover sheet 250 or adhesive.

Figure 28:
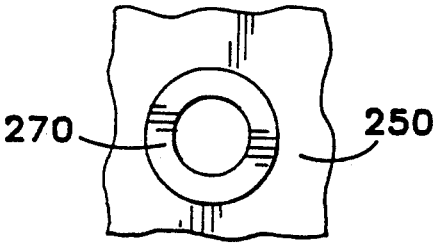
FIG. 28 is a sectional view of a cover sheet for a connector such as that shown in FIG. 23, showing a contact base such as that shown in FIG. 27.
Figure 29:
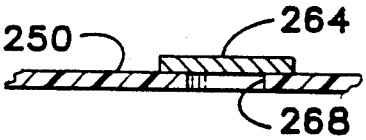
FIG. 29 is a view of a contact base of a different type for use in a connector such as that shown in FIGS. 23-26.
Figure 30:
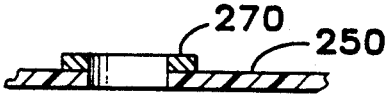
FIG. 30 is a sectional view of a cover sheet for a connector such as that shown in FIG. 23, showing a contact base such as that shown in FIG. 29.

Alternatively, the contacts 256 may incorporate contact bases 270, such as the one shown in FIGS. 28 and 30, and connection to the central conductors 76 may be achieved by electroplating techniques or curable conductive pastes as described previously in connection with the embodiments of the invention disclosed in FIGS. 14, 16 and 17.

The cover sheet 250 may be applied and adhered to the substrate template 242 by an adhesive sprayed on the joint surface 252 of the substrate template 242 only outside the area of the array of contacts 256. Alternatively, use of a heat-activated pressure-sensitive adhesive applied as a spray to the underside of the cover sheet 250 prior to laser cutting the blind vias 268 is also satisfactory in the embodiment of the invention disclosed in FIG. 32.

Figure 31:
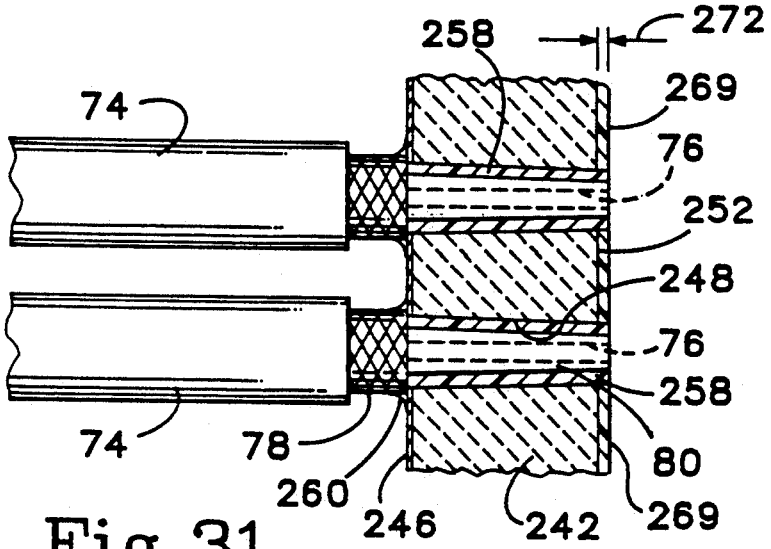
FIG. 31 is a sectional detail view of a connector which embodies a variation of the structure of the connector shown in FIGS. 23-26, at an intermediate stage during its manufacture.

In order to provide for better adhesion and electrical connection between the ends of the conductors and the respective contact bases 264 through a blind via 268, it is also possible to prepare a connector similar to the connector 240 by inserting the central conductors 76 along with the surrounding intermediate dielectric material 80 into a template 242, protruding as shown in FIG. 31, after which a layer 269 is formed of an easily removable material such as wax. The layer 269 and central conductors 76 are polished to a desired thickness 272. A dielectric potting material 258 is installed from the back of the template substrate 242 to fill the space within the conductor apertures 248, surrounding the central conductor 76 and the intermediate dielectric material 80, extending to the surface 252 of the template substrate 242. Thereafter, the layer 269 is removed by use of heat or chemicals, leaving only the central conductor 76 and the surrounding dielectric material 80 protruding above the surface of the template substrate 242 by a distance equal to the thickness 272, as shown in FIG. 31. Thereafter, the dielectric material 80 immediately surrounding the central conductors 76 is removed along with portions of the potting material 258 to about the same depth as or slightly below the joint surface 252, as by the use of a UV laser, thus leaving the end portion of each central conductor 76 extending above the surface of the template substrate 242 by the distance equal to the thickness 272.

Figure 32:
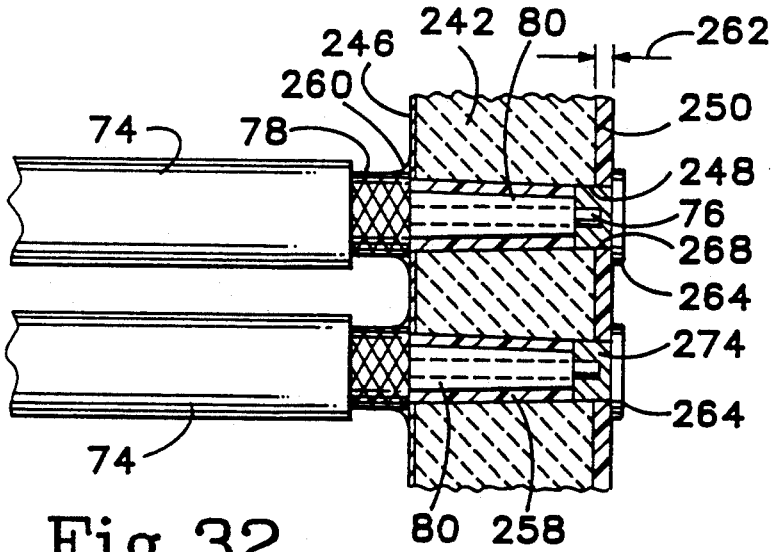
FIG. 32 is a view similar to that of FIG. 31, showing the structure of the completed connector.
Figure 33:
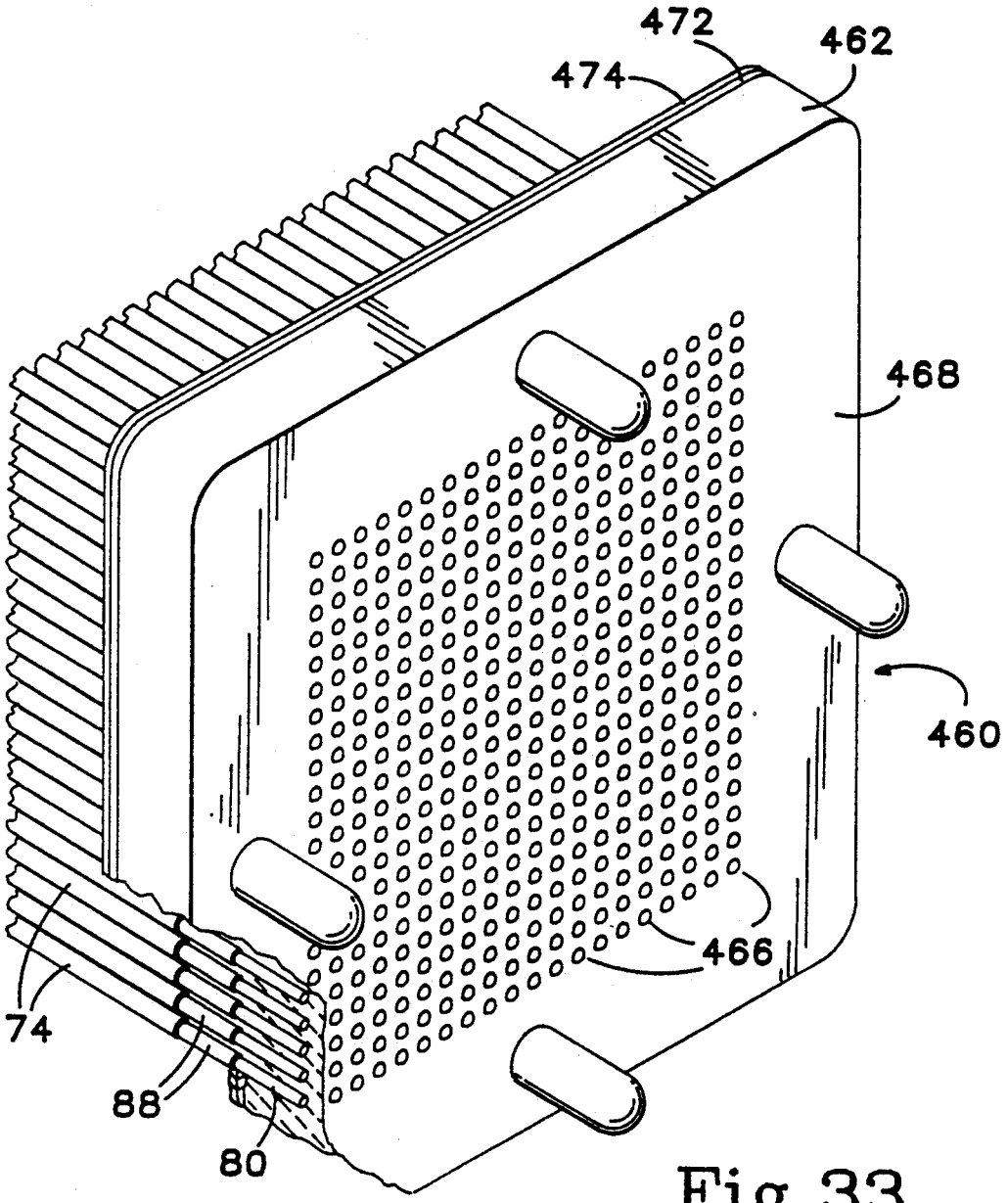
FIG. 33 is a perspective view of a connector according to the present invention whose construction is somewhat different from that shown in FIGS. 23-32.

As shown in FIG. 32, a cover sheet 250 whose thickness 262 is greater than the thickness 272 is then applied to the surface of the template substrate 242. The cover sheet 250 defines a blind via 268 located precisely to correspond with the location of each of the conductor apertures 248, and contact bases 264 are located on the cover sheet 250, aligned with the blind vias 268. Prior to application of the cover sheet 250 to the template substrate 242 each blind via 268 and the area around the conductor where dielectric ablated is filled with a conductive material 274, such as a conductive epoxy or a solder paste, into which the end of each central conductor 76 extends to create an electrical connection between the central conductor 76 and the associated contact base 264.

Figure 34:
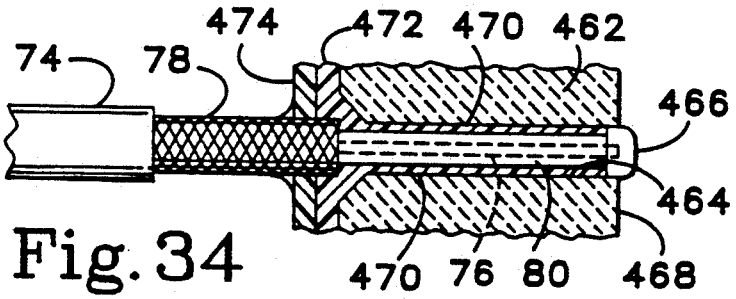
FIG. 34 is a sectional view of a detail of the connector shown in FIG. 33.

Referring now to FIGS. 33–36, a connector 460 includes a template substrate 462 similar to the template substrate 244 of the connector 240 shown in FIG. 23, and a plurality of coaxial pairs 74 are attached to the template substrate 462. Referring also to FIG. 34, showing a detail of the connector 460, a central conductor 76 and the associated dielectric material 80 of each coaxial pair 74 extend into a respective conductor aperture 464 defined by the template substrate 462. As in the template substrate 244, the conductor apertures 464 may be provided at spacing at least as close as 0.635 mm (0.025 inch) center-to-center, in a rectangular array of, for example, 22 rows each including 20 conductor apertures 464. A similar number of corresponding contacts 466 are located in a precise array on a mating surface 468 defined by the template substrate 462. Conductor apertures 464 may, as the conductor apertures 248, have a diameter of about 0.33 mm (0.013 inch), for example, and each of the contacts 466 may have a similar or a slightly larger diameter, up to about 0.38 mm (0.015 inch).

Figure 35:
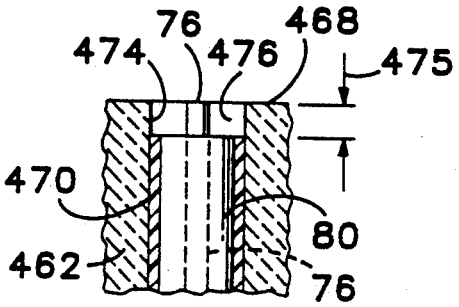
FIG. 35 is a sectional view of a detail of the connector shown in FIG. 33, at an enlarged scale, at one stage during assembly of the connector, showing one step of the process of preparing such a connector and connecting it to the coaxial conductor pairs of a cable.
Figure 36:
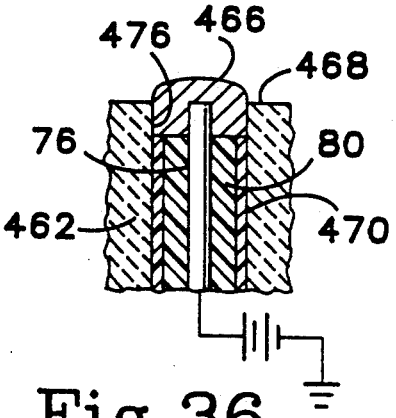
FIG. 36 is a sectional view similar to that of FIG. 35, showing a further stage of preparation of the connector.
Figure 37:
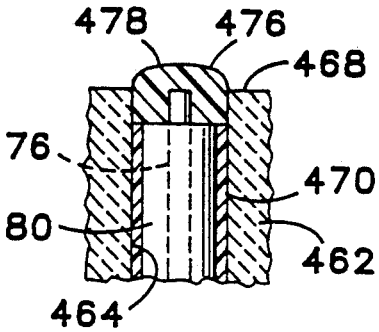
FIG. 37 is a sectional view similar to that of FIG. 35, showing a detail of a connector which is a slightly different variation of the connector shown in FIGS. 35 and 36 at one stage during its preparation.
Figure 38:
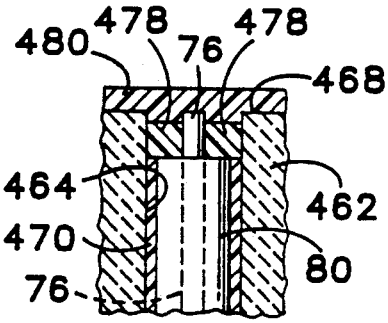
FIG. 38 is a sectional view of the portion of a connector shown in FIG. 37 at a subsequent stage of its preparation according to the invention.

The connector 460 is prepared and connected to the individual coaxial conductor pairs 74 as shown in FIGS. 34, 35, and 36, by stripping the outer jacket and the shield conductor 78 of each coaxial pair 74 to expose a portion of the intermediate dielectric material 80 surrounding a portion of the central conductor 76. The intermediate dielectric material 80 and central conductor 76 are then inserted into a respective one of the conductor apertures 464, protruding slightly on the front side of the template substrate 462. When all or at least a manageable number of the individual conductor pairs 74 have thus had their central conductors and the associated dielectric material 80 inserted into the template substrate 462, potting material 470 is applied in liquid form, forming a layer 472 along the back side of the template substrate 462 and also filling in the available space within each of the conductor apertures 464 surrounding the dielectric material 80 and within the dielectric material 80 to secure each of the conductor pairs 74 to the template substrate 462. It will be noted that the shield conductor 78 extends close to the back side of the template substrate 462 and is preferably surrounded by the potting material 470 of the layer 472. The potting material 470 is electrically non-conductive material and may be the same as that used as the potting material 50 and the potting material 84 mentioned previously.

Applied over the layer 472 of non-conductive potting material is a layer 474 or coating of electrically conductive material such as that previously described for the layer 98 in the embodiment of the invention shown in FIG. 13. The layer of material 474 is electrically connected to each shield conductor 78, forming a common potential interconnection among all of the shield conductors 78 of the several coaxial conductor pairs 74 associated with the connector 460.

Referring now specifically to FIGS. 35 and 36, when all of the coaxial conductor pairs 74 have been attached to the template substrate 462, the portions of each of the central conductors 76 and the associated dielectric material protruding beyond the mating surface 468 of the template substrate 462 are cut off close to the mating surface 468, as by an abrasive cutting disk, and are then ground and polished together with the template 462 to form a continuous planar surface corresponding with the mating surface 468. Thereafter, a portion of the dielectric material 80, together with the associated potting material 470, is removed to a small depth 475 such as 0.05–0.10 mm (0.002–0.004 inches) below the mating surface 468, as by the use of a UV laser of appropriate power and appropriately controlled, to leave a small cavity 476 within the conductor aperture 464, with the central conductor 76 exposed within the cavity 476. Thereafter, each central conductor 76 is connected appropriately to an electrical power supply and material is deposited on the central conductor 76 by electroplating to form the individual contacts 466. Each contact 466 is formed to protrude slightly above the plane of the mating surface 468, as shown in FIG. 36. Preferably, for the sake of economy, the bulk of each contact is made up of copper deposited by electroplating, and a layer of nickel is applied to the copper and covered by a final thin layer of gold to provide corrosion resistance and conductivity to assure electrical contact during use of the connector 460.

Figure 39:
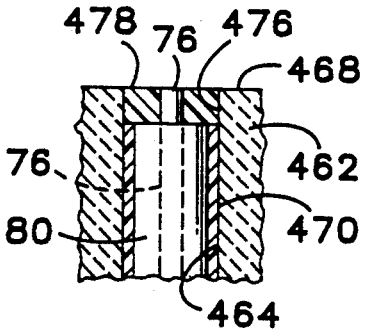
FIG. 39 is a sectional view similar to that of FIG. 38 at a further subsequent stage of preparation of the connector according to the present invention.
Figure 40:
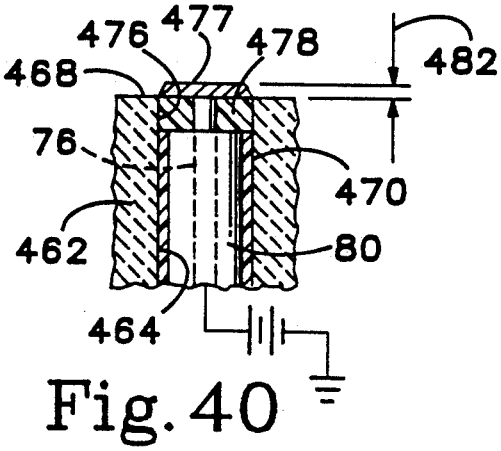
FIG. 40 is a sectional view similar to that of FIG. 37 showing a detail of the completed connector of the type shown in FIG. 37.

Referring to FIGS. 37–40, as an alternative to the contacts 466, contacts 477 may be constructed by first partially filling each cavity 476 (FIG. 35) with a quantity of castable conductive material 478 such as a conductive epoxy of the type described for use as the layer 98 of the connector 90 shown in FIG. 13. After being placed into the respective cavities 476 the conductive material is preferably cured in a nitrogen purged cavity in an oven at 45 psi pressure to assure compression of air bubbles which might be captured within the several cavities 476. This may produce a layer of such castable epoxy material 478 slightly below the level of the mating surface 468, as shown (somewhat exaggerated) in FIG. 38. Thereafter, a further layer 480 of conductive castable material is applied to cover the layer 478, the central conductors 76, and the mating surface 468 of the template substrate 462. After the layer 480 of conductive material has been cured a part of it is ground away, together with portions of the central conductors 76, to expose the template substrate 462 between the conductor apertures 464, so that the central conductors 76 are again electrically isolated from each other as shown in FIG. 39. The mating surface 468 and the exposed end of the central conductors 76, together with the conductive epoxy or similar material surrounding the central conductors 76 are all polished to provide a flat mating surface 468. Finally, the contact 477 is completed by depositing one or more layers of conductive metal, such as a bottom layer of nickel and a thinner cover layer of gold, as by electroplating the metal onto the conductive castable material and the central conductors 76, in the configuration shown in FIG. 40. Preferably the contacts 477 thus produced will be generally flat-topped but will protrude to a height 482 of about 0.05 mm (0.002 inch), with an exposed surface of gold to resist corrosion and provide the desired high conductivity for each contact 477.

Figure 41:
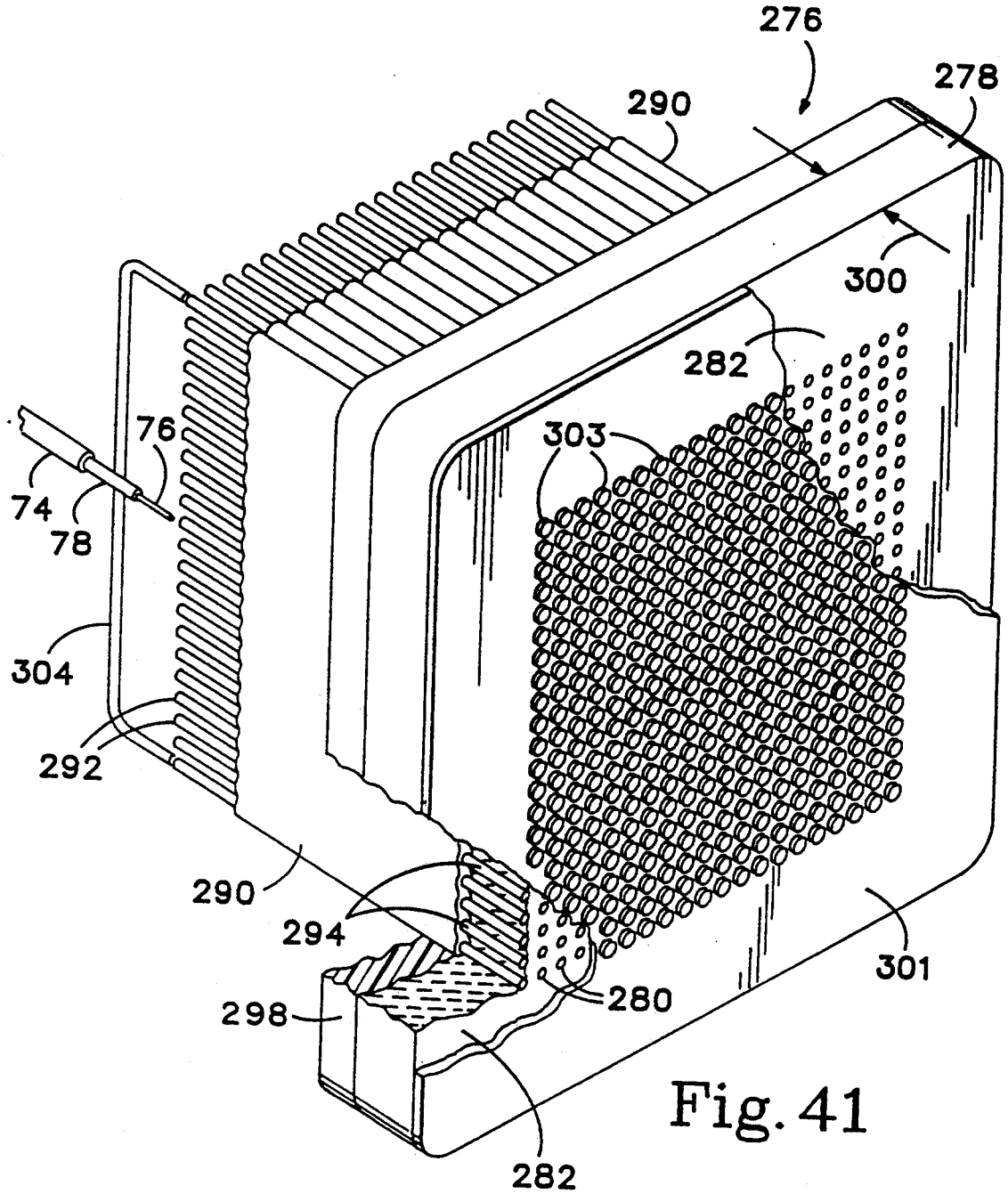
FIG. 41 is a perspective view of a connector according to the present invention including multiple ribbon cables acting as terminals for connection of individual conductors of a multi-conductor cable.

In a slightly different embodiment of the invention, as shown in FIG. 41, a connector 276 includes a template substrate 278 defining an array of conductor apertures 280 for receiving the individual conductors 292 of a plurality of ribbon cables 290 each including a plurality of solid wire conductors 292. Each of the conductor apertures 280 may have a diameter, for example, of 0.254 mm (0.010 inch).

Such ribbon cables 290 might be connected, for example, to printed circuits of an electronic device to which a multi-conductor cable is to be connected. It is also feasible to connect the individual conductors 26 or conductor 74 pairs of a cable to the wires 292 of the ribbon cable. Preferably, each ribbon cable 290 has as many individual conductor wires 292 as there are conductor apertures 280 in a single row, and as many ribbon cables 290 are utilized with the connector 276 as there are rows of conductor apertures defined in the template substrate 278. The insulation is removed from terminal portion 294 of each wire 292. The ribbon cable 290 may, for example, have 20 wires extending parallel with each other, and spaced apart from one another within the insulation by a distance of 0.635 mm (0.025 inch), center-to-center, with each wire having a diameter of approximately 0.20 mm (0.008 inch).

Each ribbon cable 290 is installed in the template substrate 278 with each of the terminal portions 294 extending through a respective one of the conductor apertures 280. A quantity of a potting material 298 is applied to the ribbon cable 290 and the backside of the template substrate 278, to fasten and fix in place the ribbon cable 290 with the terminal portions 294 of the wires extending through the template substrate 278, protruding slightly forward from the joint face 282. The ribbon cable 290 is preferably prepared so that the bared terminal portion 294 has a predetermined length of slightly more than the thickness 300 (for example, 0.762 mm (0.030 inch)) of the template substrate 278. For example, the terminal portion 294 preferably is stripped over a distance of about 0.125 mm (0.005 inch) greater than the thickness 300.

Preferably, after the conductors 292 of the ribbon cables 290 have been placed into the respective apertures 280, a light coating of a silicone grease is applied to the joint face 282 to prevent the preferred potting material 298, which is very fluid, from penetrating through the entire length of each conductor aperture 280. The potting material 298 is then poured on the back side of the template substrate 278 to fill the available space surrounding each ribbon cable 290 and the space within each conductor aperture 280 surrounding a portion of the length of each of the individual conductors 292.

The potting material 298 is then cured, after which the silicone grease is removed. The exposed ends of the individual conductors 292 are then lapped and polished, together with the front face of the template substrate 278, to form the planar joint face 282 including the ends of the conductors 292 exposed as contacts.

Figure 42:
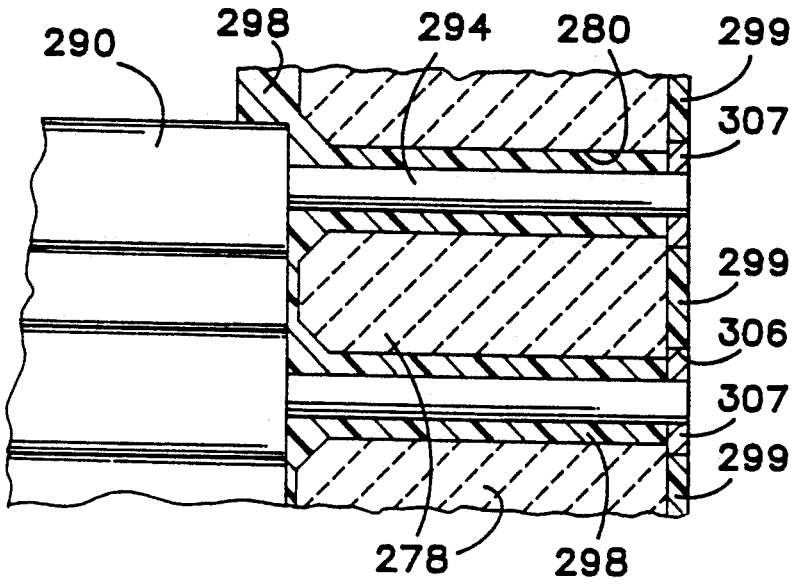
FIG. 42 is a sectional view of a detail of a connector similar to that shown in FIG. 41 at an intermediate stage during its manufacture.

A slightly different procedure also useful for preparing such connectors is to apply a layer of castable, but removable material or a template 299 of a material such as a glass-filled epoxy as shown in FIG. 42 to the front face of the template substrate 278. The template 299 defines apertures 306 filled with wax 307 surrounding the bared ends of the conductors 292. The castable material or template 299 and the ends of the conductors 292 are then shaped and lapped to a thickness of about 0.05 mm (0.002 inch) with the exposed ends of the individual conductors 292 embedded in the castable material or wax. The castable material or the template 299 is then removed from the front face of the substrate template 278, leaving the terminal portions 294 of the individual conductors 292 protruding by the final thickness of the lapped castable material or the template 299.

Figure 43:
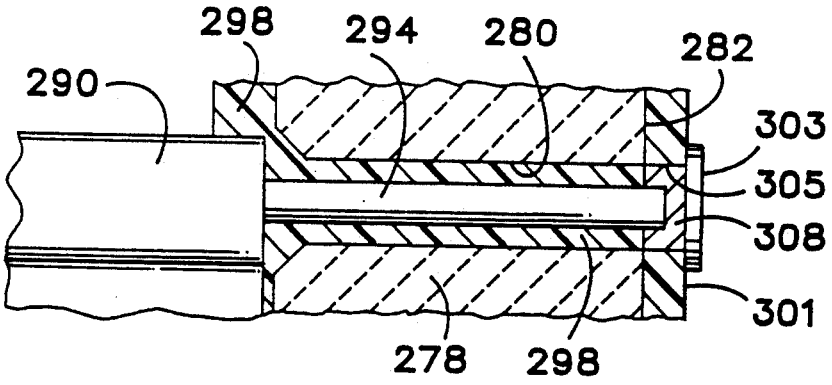
FIG. 43 is a sectional view of a detail of a connector similar to that shown in FIG. 41 in a completed state.
Figure 44:
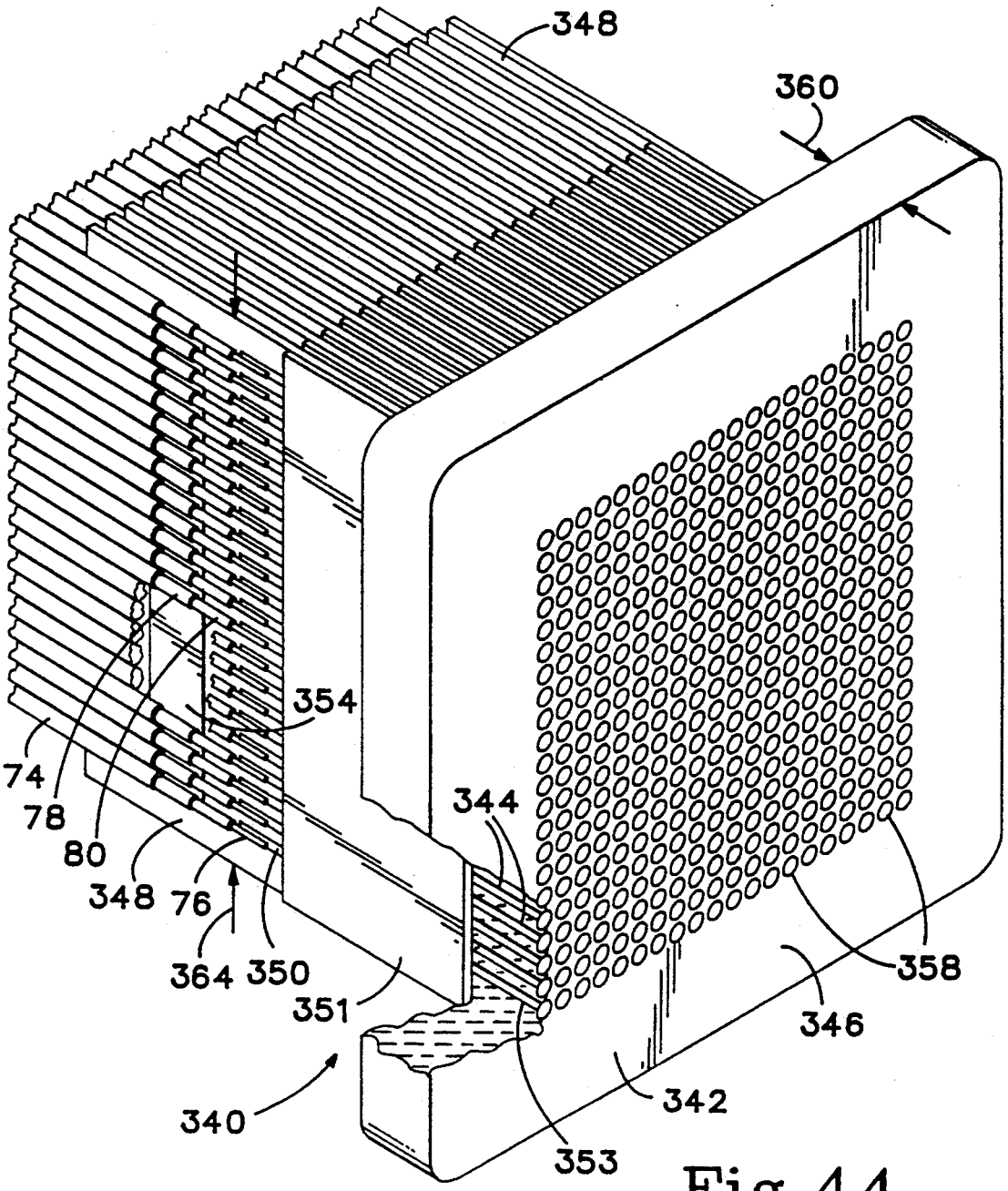
FIG. 44 is a perspective view of a connector which is another embodiment of the present invention, together with a short terminal portions of the individual coaxial conductor pairs of a multi-conductor cable.

As shown in FIG. 43, upon removal of the castable material or a template 299 from the joint surface 282, a cover sheet 301 may then be attached, held in place by a layer of an adhesive, not shown. The cover sheet 301 is similar to the cover sheet 250 previously described (FIG. 22), and has a precisely formed array of contact bases 303 located thereon. Preferably, blind vias 305 are formed through the flexible material of the cover sheet as previously described with respect to the cover sheet 250, each blind via 305 communicating with one of the contact bases 303. Prior to placement of the cover sheet 301 against the joint face 282 the blind vias 305 are filled with conductive material 308 as described in connection with the cover sheet 250. Because of the adhesive effect of the conductive material, further adhesive materials need be applied only in the areas of the substrate template 278 and the cover sheet 301 surrounding the array of conductor apertures 280 and blind vias 305. If the template substrate has been prepared to use of a UV laser of leave the ends of the conductors 292 protruding, these protruding ends will extend into the blind vias to contribute to the effectiveness of the electrical connection.

When the connector 276 is utilized for connection of coaxial pairs 74, the shield conductor 78 of each of the coaxial conductor pairs may be electrically connected to a ground bus wire 304 connected as shown to one or more of the wires of the ribbon cable 290 to which the central conductors 76 of the coaxial conductor pair is attached.

As yet a further embodiment of the invention, a connector 340 shown in FIGS. 44-50 includes a template substrate 342 defining a plurality of conductor apertures 344 in the form of parallel holes extending through the template substrate 342. As in the previously-described embodiments of the present invention, the template substrate 342 may be of a dielectric material similar to the previously-described template substrates and has a front or mating surface 346. The conductor apertures 344 extend parallel with each other through the template substrate 342 to the mating surface 346 and are spaced-apart from one another by a distance of, for example, 0.635 mm, center-to-center, in one embodiment of the invention. For example, there may be 20 of the conductor apertures 344, and extending into each of the conductor apertures 344 in a respective flex circuit 348 including a plurality of conductive traces 350 extending longitudinally of the flex circuit 348 along a base sheet 349 parallel with one another and spaced-apart by a center-to-center distance of 0.635 mm (0.025 inch), for example. The base sheet 349 may be of polyimide or other dielectric flexible sheet material well known for use in flex circuits.

The conductive traces 350 extend from a front end 352 of each flex circuit 348 a part of the distance toward the opposite end of the flex circuit, where all of the conductor traces end at a location spaced a small distance apart from a common bus terminal 354 which extends transversely of the base sheet 349 near the ends of the conductive traces 350. The bus terminal 354 is not usually connected to any of the conductive traces 350 although a bridge trace 355 shown in broken line could optionally be provided. A cover sheet 351 is attached adhesively to the base sheet 349 and traces 350, leaving each end of each trace 350 exposed for a short distance to permit access thereto to make electrical connection.

Figure 45:
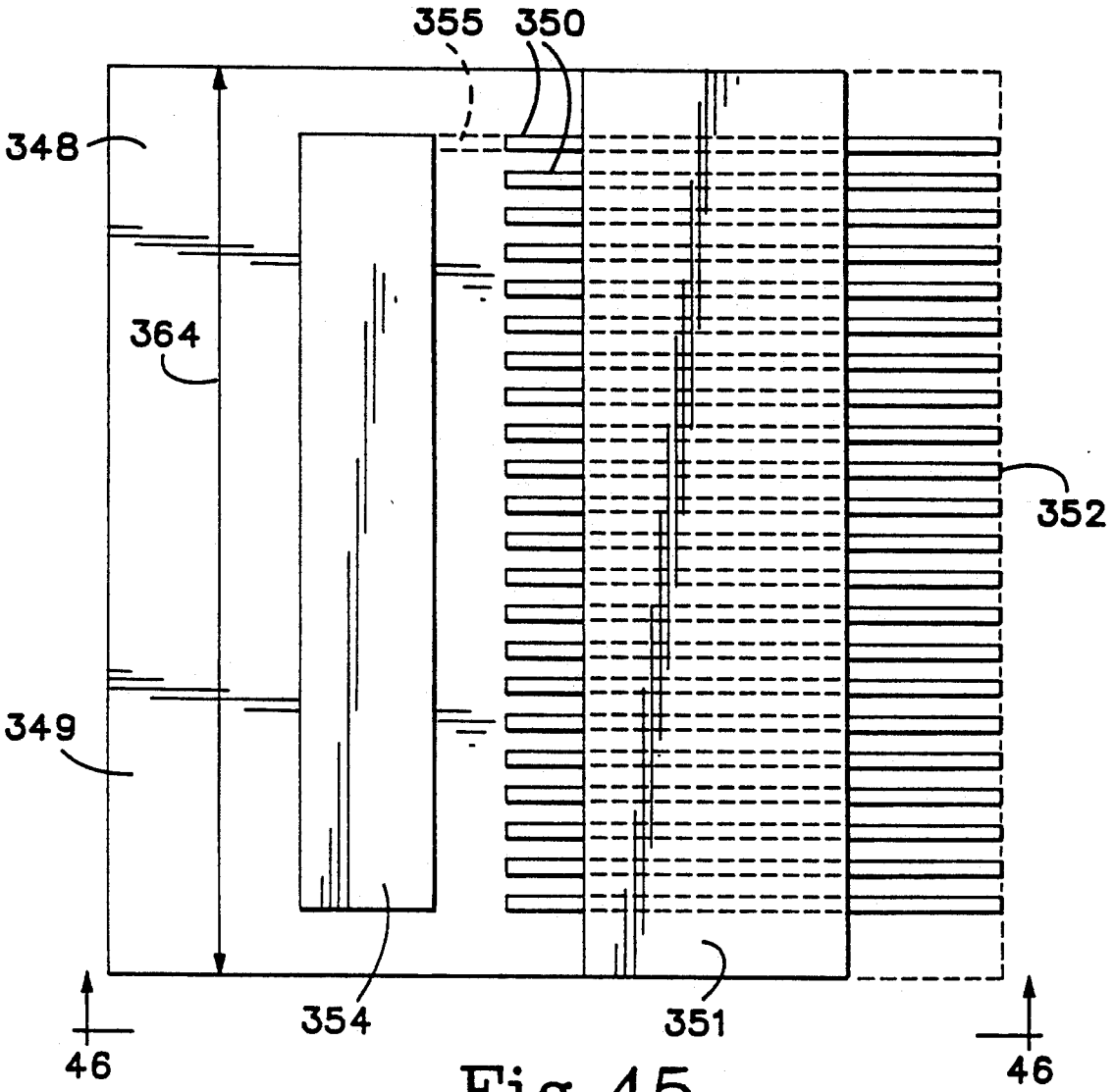
FIG. 45 is a plan view of a flex circuit portion of the connector shown in FIG. 44.
Figure 46:
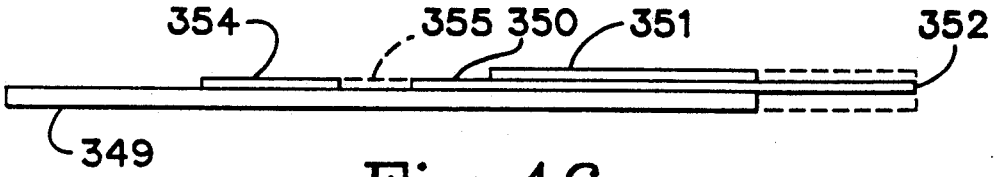
FIG. 46 is a side view, taken along the line 38—38, of the flex circuit shown in FIG. 45.
Figure 47:
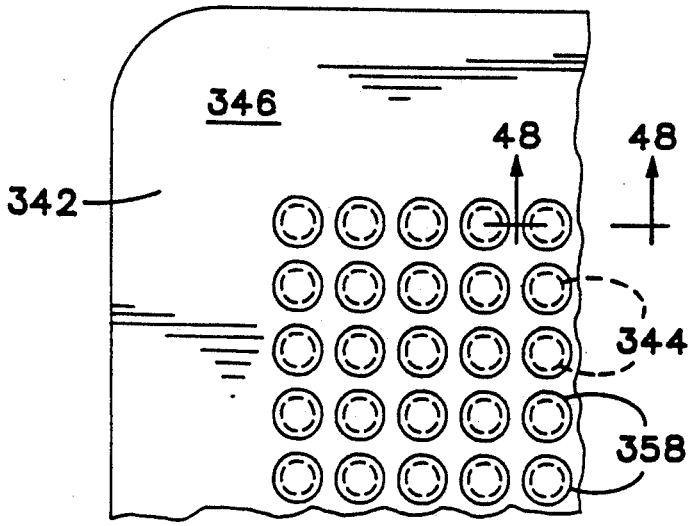
FIG. 47 is a front view of a detail of the connector shown in FIG. 44, at an enlarged scale.

At the front end 352 the cover sheet may be attached to extend to the ends of the traces 350 and the base sheet 349, and both the base sheet 349 and the cover sheet 351 are then trimmed back as shown by broken lines in FIGS. 45 and 46 to expose a portion 353 of the conductive traces 350. This can be accomplished by lasers.

A plurality of coaxial conductor pairs 74 may be connected to each of the flex circuits 348, and each flex circuit 348 extends into a respective one of the conductor apertures 344, where it is held by a quantity of potting material 356. Once all of the flex circuits 348 have been inserted in their respective individual conductor apertures 344 and the potting material 356 holding each in place has been cured, the flex circuits are trimmed flush with the mating surface 346, which may then be ground and polished flat, together with the potting material and the portions of the flex circuits exposed on the mating surface side of the template substrate.

Figure 48:
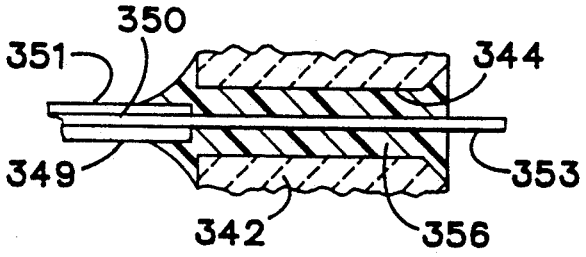
FIG. 48 is a sectional view of a detail of the connector shown in FIG. 44, taken along line 48—48 of FIG. 47, showing the connector at one stage in the process according to the present invention of preparing the connector.
Figure 49:
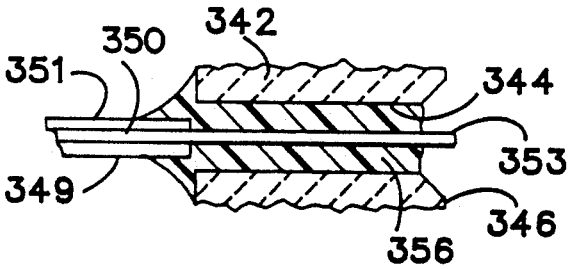
FIG. 49 is a view similar to that of FIG. 48, showing the connector shown in FIG. 43 at a later stage in the process of preparation of the connector.
Figure 50:
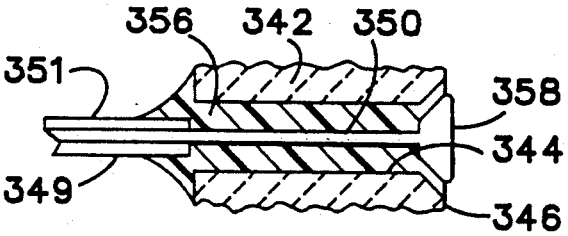

As may be seen best in FIGS. 48, 49, and 50, each of the conductor apertures 344 may be chamfered to leave more space on each side of the flex circuit 348 at the mating surface 346. Contacts 358 are larger than the exposed cross-sectional area of the individual conductive traces 350 and are prepared preferably by removing some of the potting material located within the conductor apertures 344 by use of a laser, particularly in the chamfered portion adjacent the mating surface 346 (if potting material 356 has been introduced into that portion of the conductor apertures 344).

The template substrate 342 may be of a size similar to that of the previously-described template substrates, for a similar number of conductors, and has a thickness 360 of, for example, about 3 mm.

Figure 51:
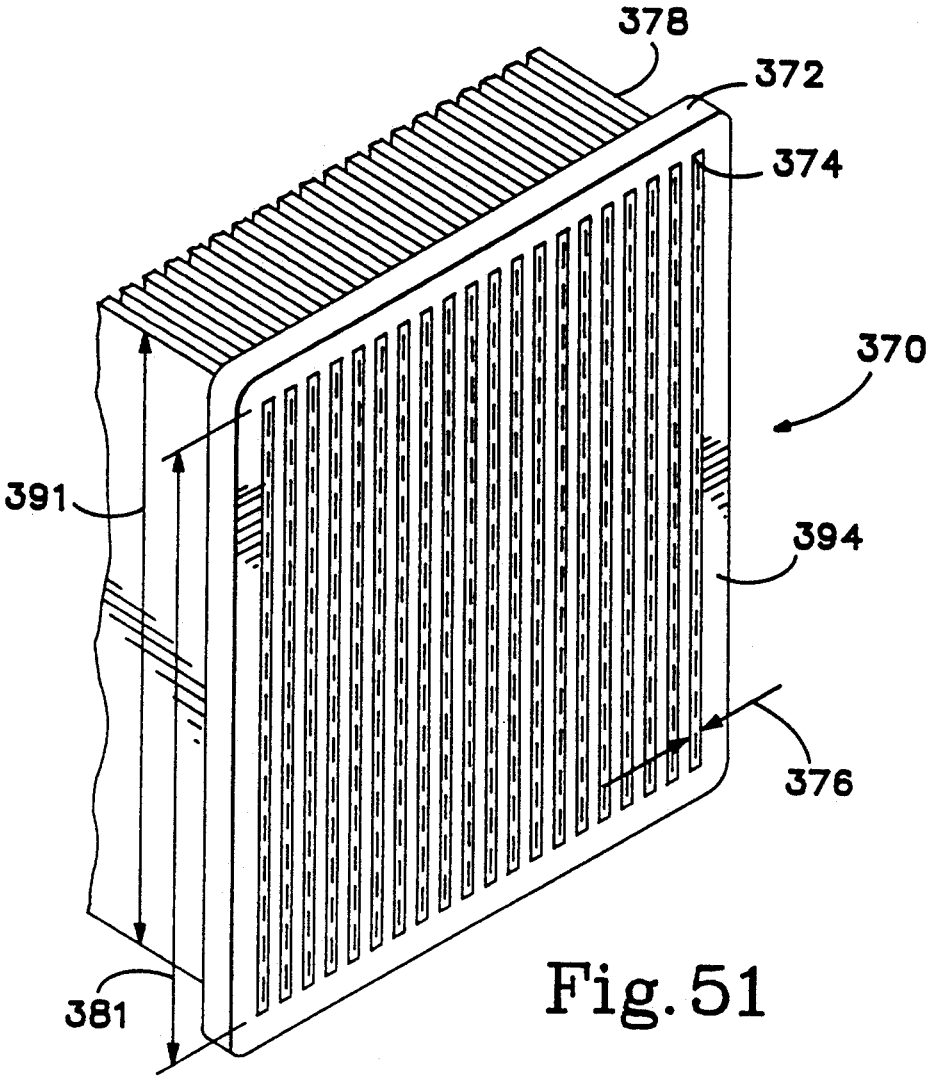
FIG. 51 is another view similar to that of FIG. 48, showing a connector such as that shown in FIG. 44 upon completion.
Figure 52:
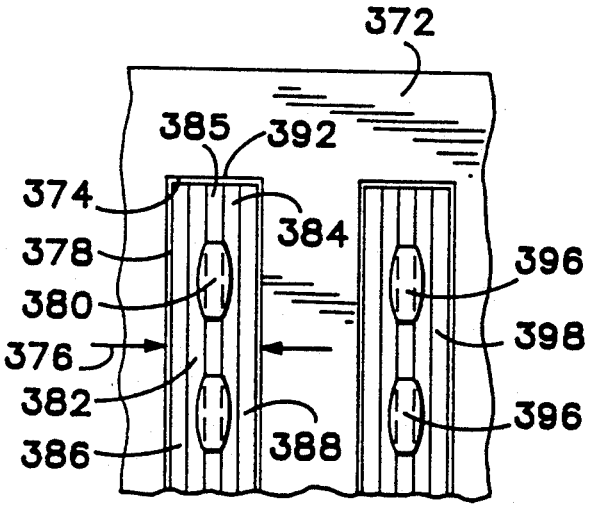
FIG. 52 is a front view of a detail of the face of the connector shown in FIG. 48, at an enlarged scale.

A connector 370, shown in FIGS. 51 and 52, is a variation of the connector 340 and includes a template substrate 372 with elongate, parallel conductor apertures 374 in the form of slots each having a width 376 of about 0.43 mm (0.017 inch). Flex circuit members 378, installed in respective ones of the apertures 374 and secured by potting material 379, include conductive traces 380 formed by conventional means on a flex substrate 382, and a flex cover sheet 384 is attached atop the traces 380 by an adhesive material 385 which also substantially fills the spaces defined between the substrate 382 and cover sheet 384 and between the traces 380. Additionally, ground plane layers 386 and 388 of conductive material such as metal foil are attached by adhesives (not shown) to the flex substrate 382 and flex cover 384 as ground plane conductors to provide shielding for the conductor traces 380 where they pass through the connector 370.

The flex substrate 382 and cover 384 are of a flexible dielectric material such as a polyimide with a thickness of, for example, 0.127 mm (0.005 inch) each, while the traces 380 and the foil layers 386 and 388 are of a conductive metal such as copper having a thickness of 0.05 mm (0.002 inch), giving a thickness 390 of about 0.406 mm (0.016 inch) for each cladded flex circuit 378. The flex cover 384 and the associated foil layer 386 on one side of each cladded flex circuit 378 may be shorter than the remainder of the flex circuit 378, to provide access to the traces 380 for connection of circuit or cable conductors to the individual traces 380 in essentially the same manner as for attachment to the flex circuits 348 of the connector 340.

Each of the conductor apertures 374, in the form of a slot, has a length 381 greater by a minimum distance of, e.g. 0.025 mm (0.001 inch), than the width 391 of each flux circuit 378 to permit each cladded flex circuit to be inserted into a respective one of the conductor apertures 475 so that the tracer 380 of all of the flex circuits 378 are aligned with one another.

Each of the flex circuits 378 extends through a respective one of the conductor apertures 374, and all of the flex circuits 378 are held in place in the template substrate 372 by potting material 392 which may be similar to the potting material mentioned in connection with previously-described embodiments of the invention. Once all the flex circuits 378 have been installed in the respective conductor apertures 374 and the potting material 392 has cured, the flex circuits are trimmed flush with the mating surface 394, which is then ground flat and polished together with the potting material and the portions of the flex circuits exposed on that side of the template substrate 372. The exposed portions of the traces 380 and the foil layers 386, 388 of one of a pair of mating connectors 370 of this type preferably are plated with a soft conductive metal such as gold sufficiently to enlarge the size and to create contacts protruding slightly, for example, 0.05 mm above the mating surface 394, as illustrated by contacts 396 and 398 in FIG. 44. On the other one of a pair of mating connectors 370, such plating would be provided only to a thickness sufficient to resist corrosion.

Figure 53:
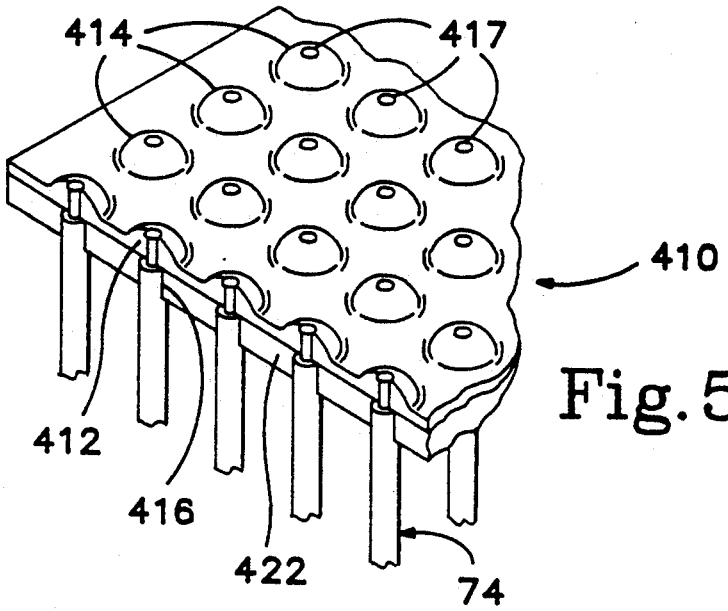
FIG. 53 is a perspective, partially sectional view of a portion of a contact array of a connector according to the present invention including a molded layer defining raised bumps as locations for contacts.
Figure 54:
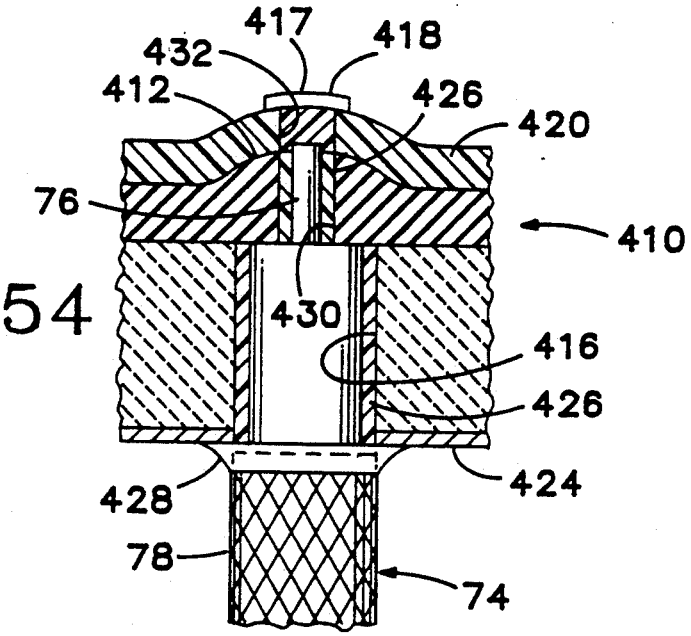
FIG. 54 is a sectional view of a detail of the contact array shown in FIG. 53.
Figure 55:
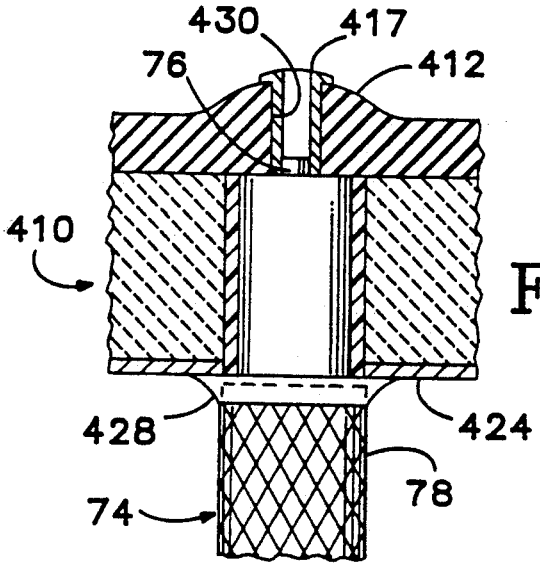
FIG. 55 is a view similar to that of FIG. 54, showing a slightly different version of the contact array.

Referring next to FIGS. 53, 54, and 55, an array 410 of contacts which may form a part of a connector somewhat similar to the connectors 110 and 112 shown in FIG. 14 includes a layer 412 of elastomeric dielectric material formed, as by molding, in a shape to provide a plurality of raised areas 414 each having the shape of a truncated sphere or spheroid, somewhat less than a hemisphere. The elastomeric material may be similar to that of the previously-described elastomeric layer 126 in the connector 112. Each raised area 414 is aligned centrally with a respective conductor aperture 416, corresponding structurally with one of the conductor apertures 118 of the connectors 110 and 112. A respective contact 417 is located atop each one of the raised areas 414.

In a preferred embodiment, as shown in FIG. 54, the contacts 417 include contact bases 418 of conductive material such as metal foil applied as a laminate to a cover sheet 420 of material such as the previously-described polyimide or polyethylene dielectric sheet material well known as material for base layers of flex circuits, and the contact bases 418 are preferably similar to the contact bases 264 and 270 described previously.

The cover sheet 420 carrying the contact bases 418 is aligned with the elastomeric layer 412, so that the contact bases are located over the raised areas 414 defined in the elastomeric layer 412. The material of the cover sheet is softened and simultaneously fastened to the elastomeric layer 412 by application of heat to activate a heat-activated adhesive while applying appropriate pressure to conform the cover sheet 420 tightly against the surface of the elastomeric layer 412.

A template substrate 422, which may be of materials such as those previously described for template substrates of connectors according to the invention, supports the elastomeric layer 412, which is attached to the template substrate 422 by a suitable adhesive material (not shown). A common layer 424 is attached to the back side of the template substrate 422 and may be of a conductive material such as a metal foil adhesively attached or of other conventional conductive materials which may be applied in the form of layers. The template substrate 422 defines the conductor apertures 416, and the conductors of an electrical cable to be connected utilizing the contact array 410, for example a plurality of coaxial conductor pairs 74, are installed in the template substrate 422, where they are held in place by suitable potting material 426. Suitable electrical contact is made between the shield conductor 78 and the common layer 424 by means, for example, of solder 428. The contact array 410 is preferably prepared in one of the ways described previously in connection with other embodiments of the present invention, preferably leaving a portion of the central conductor 76 extending through the conductor apertures 416 and corresponding apertures 430 defined by and extending through the elastomeric layer 412 in alignment with the apertures 416. The conductor 76 thus extends upwardly into a blind via 432 defined by the cover sheet 420, the blind via 432 exposing a portion of the underside of the contact base 418. Conductive material, such as a curable conductive epoxy is placed in the blind via 432 before application of the cover sheet 420 to the elastomeric layer 412, to establish electrical connection between the exposed end of the central conductor 76 and the contact base 418 electrically.

As shown in FIG. 55, a somewhat simpler structure for the contact array 410 is provided by omitting the cover sheet 420 and providing contacts 417 by electroplating or electroporetically depositing conductive material in electrical contact with an exposed portion of a conductor such as the central conductor 76.

Figure 57:
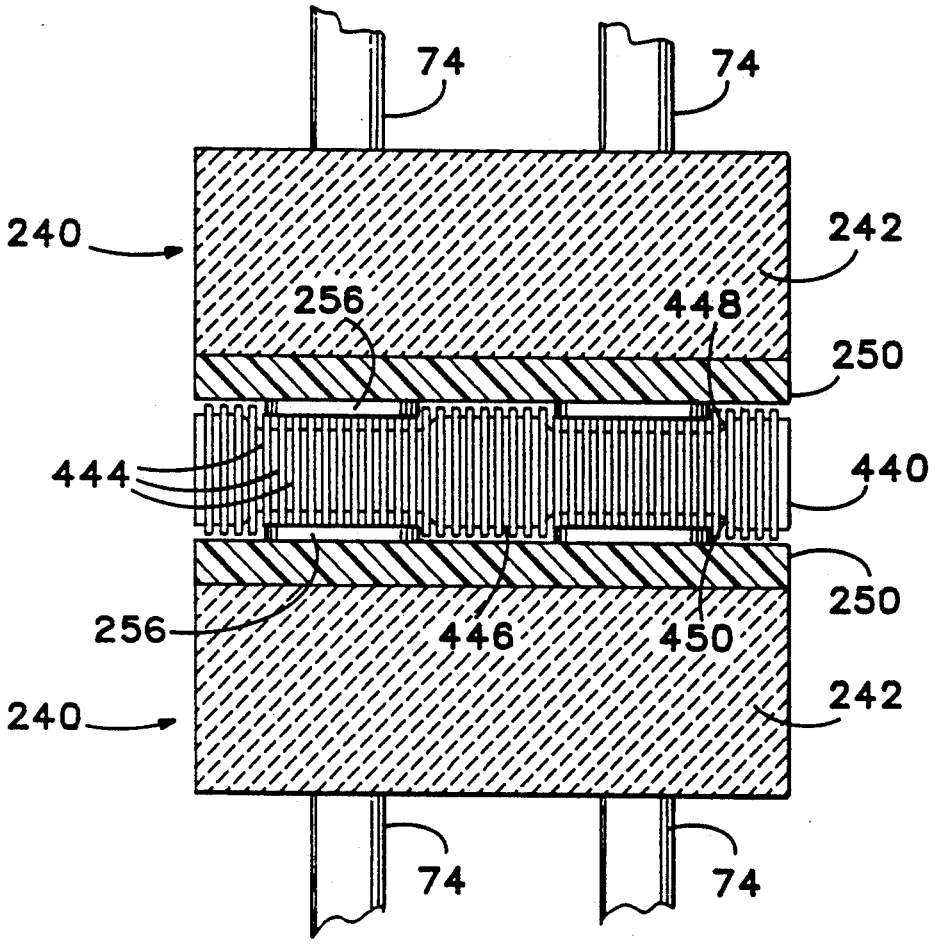
FIG. 57 is a sectional view of a detail of the connector assembly shown in FIG. 56, at an enlarged scale.
Figure 17:
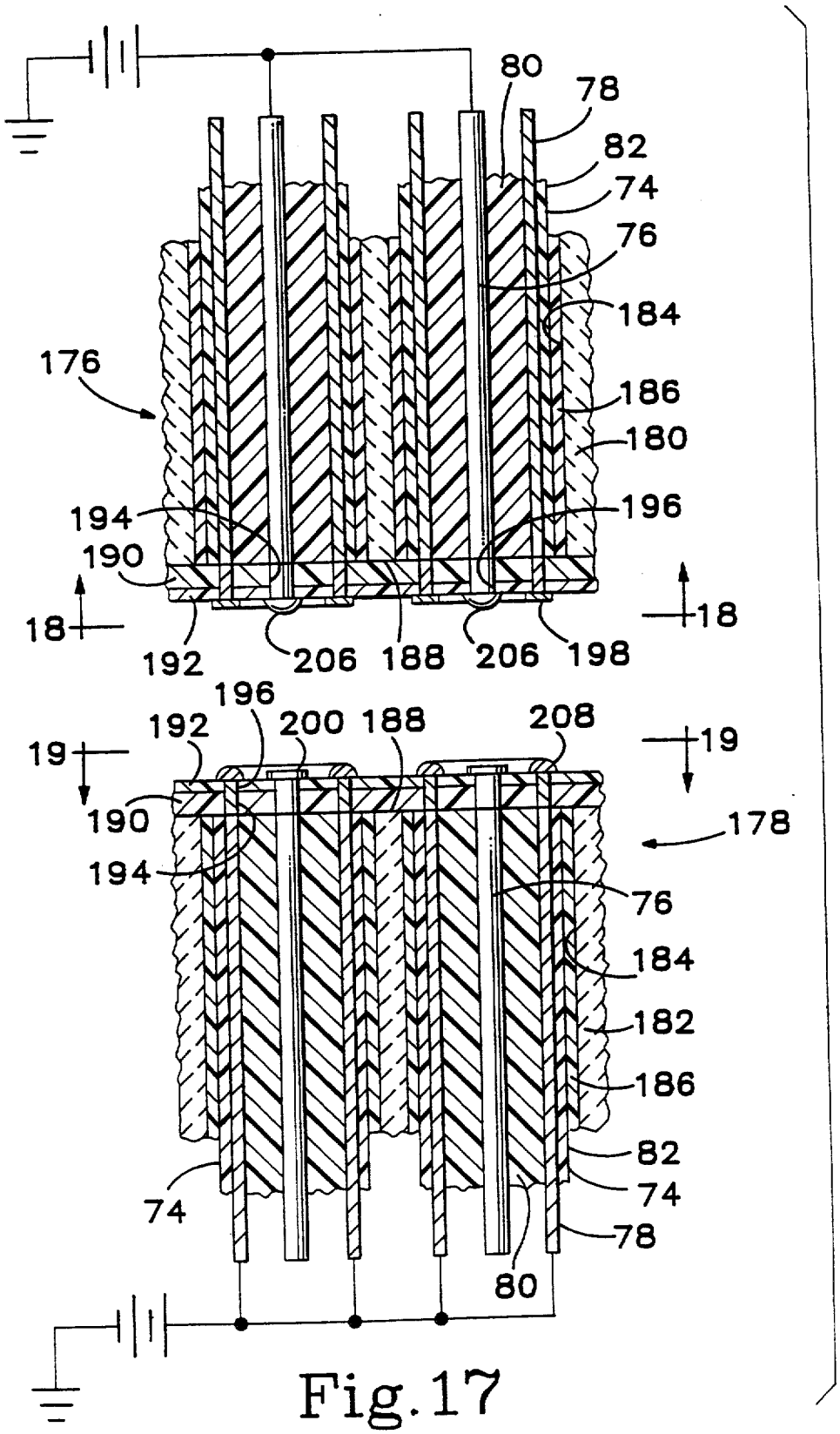

Referring now to FIGS. 56 and 57, not only is it possible to interconnect connectors according to the present invention directly with one another, but it is also possible to utilize anisotropically conductive connector sheets such as the connector sheet 440 between opposite mating faces of connectors according to the present invention. For example, in FIG. 48 portions of mating connectors 240, including template substrates 242, cover sheets 250, and arrayed contacts 256, are shown on opposite sides of such a connector sheet 440 to illustrate connection utilizing such a connector sheet 440. In FIG. 57, smaller portions of the connectors 240 are shown being held together to compress the connector sheet 440 between them, effecting electrical connection between corresponding contacts 256. The connector sheet 440 may, for example, be an anisotropic connector sheet available from Shin-Etsu Polymer of Union City, California as its MAF-connector. Such a connector sheet consists of gold or nickel-boron plated fibers 444 embedded at random spacing in a thin sheet of elastomeric dielectric material such as a silicone rubber. The metal fibers are oriented parallel with one another and generally normal to the major plane of the sheet of material, and protrude several microns above the parallel major surfaces 448, 450 to contact conductors opposed to one another on opposite sides of the connector sheet 440. For example, the connector sheet 440 may have a thickness 442 (FIG. 48) of 0.2–0.8 mm (0.008–0.031 inch), with metal fibers whose diameters are approximately 0.03 mm (0.001 inch) distributed randomly to provide approximately 2–12 fibers per $mm^2$ (1290–7740 fibers per $inch^2$) passing through the entire thickness of the connector sheet 440. Depending upon the current loads to be carried through the connector and any cables interconnected thereby, such an anisotropic connector sheet 440 is adequate in many applications of the present invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of providing a connector on a multi-conductor electrical cable, comprising:

(a) holding a respective terminal portion of each of a plurality of conductors of a multi-conductor cable in a template with said terminal portions in a predetermined spatial relationship to each other;

(b) inserting a potting material into said template surrounding said terminal portions to hold said conductors in said predetermined spatial relationship;

(c) thereafter shaping said potting material and said conductors to define, together with said template a substantially continuous joint face;

(d) including an end face of each of said conductors as a portion of said substantially continuous joint face; and (e) forming contacts by depositing a respective quantity of an electrically conductive material in electrical contact with each of said end faces of said conductors and located in a predetermined array.

2. The method of claim 1, including the further steps of attaching a cover layer of a flexible dielectric material to said joint face, providing a plurality of openings extending through said cover layer, wherein said step of forming contacts includes depositing said electrically conductive material so that it extends through respective ones of said openings.

3. The method of claim 1, including the further steps of attaching a layer of an elastomeric material to said joint face, attaching a cover layer of a flexible dielectric material to said layer of elastomeric material, and defining openings through said elastomeric material in communication between respective ones of end faces of said conductors and a plurality of predetermined locations for said contacts on said cover layer.

4. The method of claim 1 wherein said potting material is a polymeric resin.

5. The method of claim 1 wherein said step of holding a respective terminal portion of each of said plurality of conductors includes the step of inserting said terminal portion of each of said plurality of conductors into a respective one of a plurality of conductor apertures defined in said template.

6. The method of claim 1 wherein each of said conductors is a coaxial conductor pair having a center conductor and an outer conductor.

7. A method of attaching an electrical connector to a plurality of conductors of an electrical cable having a plurality of small individual signal conductors, comprising:

(a) providing a connector body including a substrate having a front face;

(b) defining an array of closely-spaced apertures extending through said substrate to form a template including said closely-spaced apertures;

(c) inserting a plurality of conductors into said template so that each of said conductors extends through a respective one of said apertures to said front face of said substrate;

(d) forming said conductors so that a portion of each conductor extends beyond said template;

(e) inserting a quantity of potting material into each of said apertures, surrounding each of said plurality of conductors therewith;

(f) curing said potting material so as to retain each of said conductors in said template;

(g) shaping said conductors and said potting material to form a joint surface having a predetermined shape including said conductors and said potting material; and (h) thereafter, attaching to said substrate a cover sheet including a plurality of contact bases located in a predetermined array thereon and forming blind vias in said cover sheet communicating with said contact bases.

8. The method of claim 7, including the further step of depositing a quantity of electrically conductive material in a predetermined pattern on said body to form respective contacts in predetermined locations with each contact electrically in contact with one of said signal conductors and each contact having a contact height.

9. The method of claim 8, including the further step of depositing a portion of said quantity of electrically conductive material on said contact bases to form said contacts.

10. The method of claim 9, including the steps of forming a plurality of conductor holes in said cover sheet, and attaching said cover sheet to said joint face of said template by an adhesive, with said conductor holes communicating between said contact bases and said electrical conductors, and thereafter depositing said electrically conductive material on said contact bases and said electrical conductors, to form said contacts and to interconnect said electrical conductors extending through said apertures of said template with respective ones of said contact bases.

11. The method of claim 9, including the steps of attaching an electrically conductive layer of material on a back side of said substrate prior to inserting said conductors through said conductor apertures, and connecting a respective plurality of shield conductors associated with said plurality of signal conductors to said electrically conductive layer of material.

12. The method of claim 7, including the further steps of removing a portion of said potting material from each of said apertures adjacent said front face of said substrate and thus forming a cavity surrounding a portion of the respective one of said conductors, and thereafter depositing a quantity of electrically conductive material in said cavity in electrical contact with said respective one of said conductors.

13. The method of claim 12, including depositing enough of said electrically conductive material to protrude to a predetermined height above said joint surface as a contact.

14. The method of claim 12 wherein a portion of said electrically conductive material is a polymer-based curable conductive material.

15. The method of claim 12, including depositing said electrically conductive material electrolytically in electrical contact with the respective ones of said conductors.

16. The method of claim 12, including the step of depositing a quantity of a curable castable electrically conductive material, curing said quantity of material, thereafter shaping said material to a predetermined shape, and thereafter depositing thereon and adhering thereto a conductive layer of a metal in electrical contact therewith as an electrical contact.

* * * * *

UNITED STATES PATENT AND TRADEMARK OFFICE

CERTIFICATE OF CORRECTION

PATENT NO. : 5,274,917

DATED : January 4, 1994

INVENTOR(S) : Scott S. Corbett, III et al.

It is certified that error appears in the above-identified patent and that said Letters Patent is hereby corrected as shown below:

In FIG. 17 correct section lines in elements 78 by substituting the attached corrected drawing sheet.

In FIG. 20, change the cutting plane line labels "20" to read --21--.

| | | |
|---|---|---|
| Col. 2, | Line 14: | Delete "472,159" and insert --471,259-- in place thereof. |
| Col. 3, | Line 64 | Change "conductor" to read --conductors--. |
| Col. 5, | Line 54 | Delete "conductor" and insert --connector-- in place thereof. |
| Col. 6, | Line 66 | Delete "51" and insert --50-- in place thereof. |
| Col. 17, | Line 68 | Delete "use of a UV laser of". |

Signed and Sealed this

Twenty-eight Day of February, 1995

Bruce Lehman

*Attest:*

BRUCE LEHMAN

*Attesting Officer*

*Commissioner of Patents and Trademarks*